US005707771A

United States Patent [19]

Matsunaga

[11] Patent Number: 5,707,771

[45] Date of Patent: Jan. 13, 1998

[54] TONER FOR DEVELOPING ELECTROSTATIC IMAGE

[75] Inventor: Satoshi Matsunaga, Tokyo, Japan

[73] Assignee: Canon Kabushiki Kaisha, Tokyo, Japan

[21] Appl. No.: 575,388

[22] Filed: Dec. 20, 1995

[30] Foreign Application Priority Data

Dec. 21, 1994 [JP] Japan ..... 6-335152
Dec. 21, 1994 [JP] Japan ..... 6-335159

[51] Int. Cl.[6] ..... G03G 9/097

[52] U.S. Cl. ..... 430/110

[58] Field of Search ..... 430/106, 109, 430/110

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 5,126,221 | 6/1992 | Chiba et al. | 430/45 |
| 5,135,833 | 8/1992 | Matsunaga et al. | 430/110 |
| 5,256,507 | 10/1993 | Aslam et al. | 430/42 |
| 5,281,505 | 1/1994 | Inoue et al. | 430/106 |
| 5,384,224 | 1/1995 | Tanikawa et al. | 430/106 |
| 5,389,485 | 2/1995 | Katagiri et al. | 430/110 |
| 5,547,800 | 8/1996 | Nishimori et al. | 430/110 |

FOREIGN PATENT DOCUMENTS

| | | | |
|---|---|---|---|
| 0407083 | 1/1991 | European Pat. Off. | G03G 9/08 |
| 0516153 | 12/1992 | European Pat. Off. | G03G 9/08 |
| 0618511 | 10/1994 | European Pat. Off. | G03G 9/087 |
| 1-128071 | 5/1989 | Japan . | |
| 4-252866 | 9/1992 | Japan . | |
| 4-358159 | 12/1992 | Japan . | |
| 4-362953 | 12/1992 | Japan . | |
| 6-59504 | 3/1994 | Japan . | |
| 6-130714 | 5/1994 | Japan . | |

*Primary Examiner*—John Goodrow
*Attorney, Agent, or Firm*—Fitzpatrick, Cella, Harper & Scinto

[57] ABSTRACT

A toner for developing an electrostatic image includes: a binder resin, a colorant and a wax. The toner is designed to have (a) a storage modulus at 100° C. ($G'_{100}$) of $1\times10^4$ Pa to $5\times10^4$ Pa, and (b) a storage modulus at 60° C. ($G'_{60}$) and a storage modulus at 70° C. ($G'_{70}$) providing a ratio ($G'_{60}/G'_{70}$) of at least 30. Because of the rheological properties, the toner shows a good fixability even at a high colorant content and shows an improved fixability immediately after power supply to a fixing device in a cold environment. The binder resin may preferably include a low-modulus component and a high-modulus component. The wax may preferably include a high-melting point wax component and a low-melting point wax component.

48 Claims, 3 Drawing Sheets

TONER FOR DEVELOPING ELECTROSTATIC IMAGE

FIELD OF THE INVENTION AND RELATED ART

The present invention relates to a toner for developing electrostatic images used in image forming methods, such as electrophotography, electrostatic recording or electrostatic printing, particularly a toner suitable for hot roller fixation.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy or print carrying a fixed toner image.

As for the step of fixing the toner image onto a sheet material such as paper which is the final step in the above process, various methods and apparatus have been developed, of which the most popular one is a heating and pressing fixation system using hot rollers or a combination of a heat-resistant film and a fixed exothermic heater for heating toner images via the film.

In the heating and pressing system using hot rollers, a sheet carrying a toner image to be fixed (hereinafter called "fixation sheet") is passed through the hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation.

In the fixing step, a hot roller surface and a toner image contact each other in a melted state and under a pressure, so that a part of the toner is transferred and attached to the fixing roller surface and then re-transferred to a subsequent fixation sheet to soil the fixation sheet. This is called an offset phenomenon and is remarkably affected by the fixing speed and temperature. Generally, the fixing roller surface temperature is set to be low in case of a slow fixing speed and set to be high in case of a fast fixing speed. This is because a constant heat quantity is supplied to the toner image for fixation thereof regardless of a difference in fixing speed.

However, the toner on a fixation sheet is deposited in several layers, so that there is liable to occur a large temperature difference between a toner layer contacting the heating roller and a lowermost toner layer particularly in a hot-fixation system using a high heating roller temperature. As a result, a topmost toner layer is liable to cause an offset phenomenon in case of a high heating roller temperature, while a low-temperature offset is liable to occur because of insufficient melting of the lowermost toner layer in case of a low heating roller temperature.

In order to solve the above problem, it has been generally practiced to increase the fixing pressure in case of a fast fixing speed in order to promote the anchoring of the toner onto the fixation sheet. According to this method, the heating roller temperature can be somewhat lowered and it is possible to obviate a high-temperature offset phenomenon of an uppermost toner layer. However, as a very high shearing force is applied to the toner layer, there are liable to be caused several difficulties, such as a winding offset that the fixation sheet winds about the fixing roller, the appearance of a trace in the fixed image of a separating member for separating the fixation sheet from the fixing roller, and inferior copied images, such as resolution failure of line images and toner scattering, due to a high pressure.

Accordingly, in a high-speed fixing system, a toner having a lower melt viscosity is generally used than in the case of low speed fixation, so as to lower the heating roller temperature and fixing pressure, thereby effecting the fixation while obviating the high-temperature offset and winding offset. However, in the case of using such a toner having a low melt viscosity in low speed fixation, an offset phenomenon is liable to be caused because of the low viscosity.

Accordingly, there has been desired a toner which shows a wide fixable temperature range and an excellent anti-offset characteristic and is applicable from a low speed apparatus to a high speed apparatus.

The use of a smaller particle size toner allows higher resolution and clarity of images but on the other hand results in a lower fixability of halftone images composed of such small toner particles. This phenomenon is pronounced in a high-speed fixing system. This is because, in a halftone image part with a small toner coverage, a toner image transferred onto a concavity of a fixation sheet receives little heat and the fixing pressure is prevented from being applied onto such a concavity because of convexities. On the other hand, a halftone toner image transferred onto a convexity of a fixation sheet receives a larger shearing force per toner particle because of a smaller toner layer thickness than a solid image portion of a larger toner layer thickness, thus being liable to cause an offset phenomenon and result in a fixed image of lower image quality.

Japanese Laid-Open Patent Application (JP-A) 1-128071 has disclosed a toner for electrophotography comprising a polyester binder resin and showing a specific storage modulus at 95° C., which however has left some room for improvement in fixability and anti-offset characteristic.

JP-A 4-252866 has disclosed a toner for electrophotography having rheological properties including a storage modulus lowering initiation temperature in the range of 100°–110° C., a specific storage modulus at 150° C. and a loss modulus peak temperature of at least 125° C. However, the storage modulus and loss modulus are both too small and the loss modulus peak temperature is too high, whereby the low-temperature fixability cannot be improved and the heat-resistance is low because of too small storage modulus and loss modulus.

JP-A 6-59504 has disclosed a toner for developing electrostatic images comprising a binder resin of polyester resin having a specific structure and having a specific storage modulus at 70°–120° C. and a specific loss modulus at 130°–180° C. However, because of a large storage modulus at 70°–120° C. and a small loss modulus at 130°–180° C., a small-particle size magnetic toner cannot be readily fixed at low temperatures and also an improvement in anti-offset characteristic is desired. The difficulty is particularly pronounced when such a small-particle size magnetic toner contains a large proportion of magnetic material. From the rheological viewpoint, the increase in amount of a colorant in a toner tends to increase the storage modulus and the loss modulus. Such a toner is liable to show noticeably inferior fixability in copied image obtained immediately after power supply to a copying machine in a cold environment, thus requiring an improvement.

JP-A 4-358159 has disclosed a developer for electrophotography comprising a vinyl polymer and two-types of polyethylene waxes (and/or two types of polypropylene waxes having different softening points), of which the one type is added at the time of polymerization and the other-type is added at the time of melt-kneading. However, the waxes used have high softening points of 100° C. or higher and the difference between the softening points between the two types of waxes is as small as 2°–20° C., the resultant toner is improved in anti-offset characteristic but is inferior in low-temperature fixability.

JP-A 4-362953 has disclosed a toner containing an isolated aliphatic acid-free carnauba wax and oxidized rice wax having an acid value of 10–30. The toner has an improved low-temperature fixability, but has low anti-offset characteristic and anti-blocking characteristic and also a low flowability.

JP-A 6-130714 has disclosed a toner comprising a fixing resin of a linear polyester and release agents including a wax having a softening point similar to that of the linear polyester and a wax having a softening point higher than that of the linear polyester. The toner has anti-blocking characteristic and anti-offset characteristic which are both at levels of practically of no problem, but has an inferior low-temperature fixability because the waxes used have too high a melting point.

SUMMARY OF THE INVENTION

A generic object of the present invention is to provide a toner for developing electrostatic images having solved the above-mentioned problems.

A more specific object of the present invention is to provide a toner for developing electrostatic images showing good fixability even in a small particle size and an increased content of a colorant, particularly a magnetic material.

Another object of the present invention is to provide a toner for developing electrostatic images capable of showing good fixability from immediately after power supply in a cold environment.

Another object of the present invention is to provide a toner for developing electrostatic images capable of showing good fixability for wide ranges of apparatus including low-speed apparatus to high-speed apparatus and also showing excellent anti-offset characteristic, anti-block characteristic and flowability.

Another object of the present invention is to provide a toner for developing electrostatic images showing good fixability and good quality of fixed images even at halftone image portions.

A further object of the present invention is to provide a toner for developing electrostatic latent images capable of providing fog-free high-density toner images for wide ranges of apparatus including low-speed apparatus to high-speed apparatus.

According to the present invention, there is provided a toner for developing an electrostatic image, comprising: a binder resin, a colorant and a wax; wherein the toner has (a) a storage modulus at 100° C. ($G'_{100}$) of $1\times10^4$ Pa to $5\times10^4$ Pa, and (b) a storage modulus at 60° C. ($G'_{60}$) and a storage modulus at 70° C. ($G'_{70}$) providing a ratio ($G'_{60}/G'_{70}$) of at least 30.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
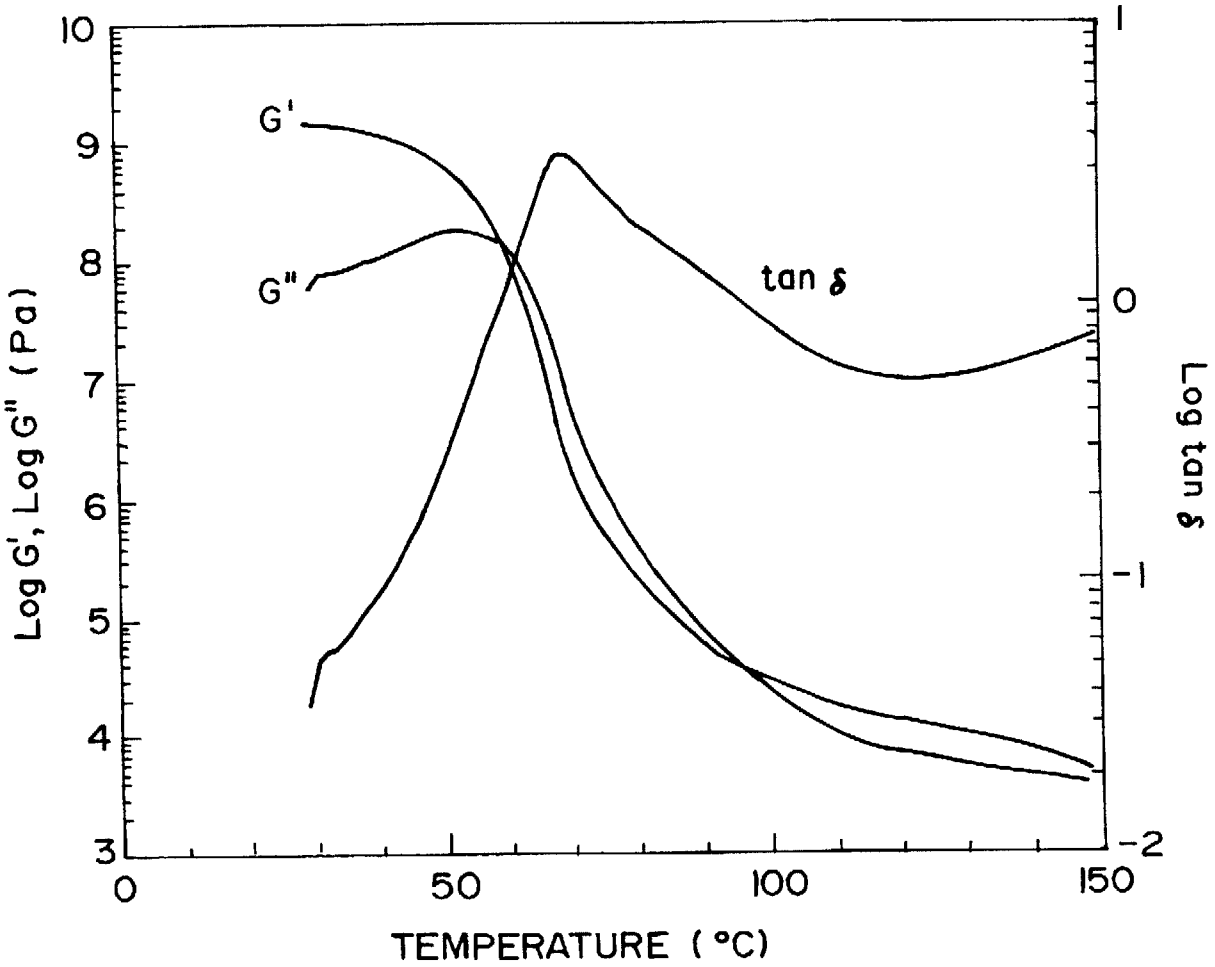
FIG. 1 is a graph showing rheological properties of a toner according to the present invention.

According to my study, in order to obtain a toner having an increased content of colorant (particularly, magnetic material) and a smaller particle size which can yet show good fixability and anti-blocking characteristic in combination by using a hot roller fixing device and also good fixability from immediately after power supply even in a cold environment, it has been found necessary to use a binder and accordingly a toner having specific rheological properties.

The rheological properties of a toner so far studied have been restricted to those relating to the fixabilities of a toner in the state of hot rollers after lapse of some time after power supply thereto, i.e., in a stand-by state, where an upper roller (heating roller) and a lower roller (pressure roller) have been sufficiently heated. It is also desired however to improve the fixability in a state immediately after power supply where the lower roller (pressure roller) has not been sufficiently heated.

The toner according to the present invention is characterized by having a storage modulus at 100° C. ($G'_{100}$) of $1\times10^4$–$5\times10^4$ Pa and a ratio of storage moduli between 60° C. and 70° C. ($G'_{60}/G'_{70}$) of at least 30.

According to my study, $G'_{100}$ depends on a degree of chain entanglement between polymer components, i.e., between high-molecular weight components and/or between a high-molecular weight component and a low-molecular weight component, constituting a binder resin contained in a toner. $G'_{100}$ may be in the range of $1\times10^4$–$5\times10^4$ Pa, more preferably $1\times10^4$–$4.5\times10^4$ Pa, further preferably $1.5\times10^4$–$4\times10^4$ Pa.

$G'_{100}$ exceeding $5\times10^4$ Pa represents the presence of much entanglement of polymer chains, and the toner cannot be readily deformed in its molten state. In case where $G'_{100}$ is below $1\times10^4$ Pa, the entanglement of polymer chains becomes few and the molten toner can be readily deformed, thus being liable to lower the anti-offset characteristic.

$G'_{60}$ and $G'_{70}$ may be understood to represent storage moduli of a binder resin in a transient state from its glass state or glass transition initiation state to a deformable state under application of an external force. A toner having a large content of colorant, particularly a magnetic toner containing a magnetic material as colorant, generally shows a correlation between the colorant content and the fixability so that an increased content tends to lower the fixability. The lowering in fixability of a toner is pronounced at a lower fixing temperature or in a state where the entire fixing device is not uniformly heated even if the fixing temperature is high. More specifically, such a lowering in toner fixability is pronounced in a state of the fixing device immediately after power supply thereto in a cold environment where the pressure roller is not sufficiently heated. This phenomenon can be explained based on a larger increase in storage modulus of a toner containing a colorant than the binder resin alone.

Accordingly, it has been found that the ratio $G'_{60}/G'_{70}$ is an important index for evaluating the fixability of a toner at a low temperature, particularly in a fixing device immediately after power supply thereto in a cold environment.

$G'_{60}/G'_{70}$ is required to be at least 30 but may preferably be 35–120, further preferably 40–110. In case where $G'_{60}/G'_{70}$ is below 30, the fixability of the toner at a low temperature or in a fixing device immediately after power supply in a cold environment, is lowered. In case where $G'_{60}/G'_{70}$ exceeds 120, only an uppermost layer of toner contacting the heating roller is liable to be excessively melted or deformed when the toner image on a fixation sheet (transfer-receiving paper) is passed through the fixing device, thus being liable to cause offset.

$G'_{60}$ of the toner may preferably be at least $7\times10^6$ Pa, more preferably $1\times10^7$–$5\times10^8$ Pa, further preferably $2\times10^7$–$4\times10^8$ Pa. A toner having $G'_{60}$ of below $7\times10^6$ Pa is advantageous in fixation at low temperatures but is liable to show inferior anti-blocking and anti-offset characteristics. $G'_{60}$ of toner in excess of $5\times10^8$ Pa is advantageous in respects of anti-blocking and anti-offset characteristics but the low-temperature fixability of the toner can be problematic.

Similarly, $G'_{70}$ of the toner may preferably be at most $7\times10^6$ Pa, more preferably $6\times10^5$–$6\times10^6$ Pa, further preferably $8\times10^5$–$5\times10^6$ Pa. $G'_{70}$ of toner in excess of $7\times10^6$ Pa may lead to a lower fixability at low temperatures, and $G'_{70}$ below $6\times10^5$ Pa may lead to a lower anti-offset characteristic.

The toner according to the present invention may preferably have a loss modulus (G") exhibiting a maximum in a temperature range of 48°–65° C., more preferably 49°–63° C., further preferably 50°–60° C. A maximum of G" at below 48° C. may lead to a lower anti-blocking performance, and a maximum of G" at above 65° C. provides a good anti-blocking characteristic but may lead to a lower fixability.

The maximum of G" of toner may preferably be $8\times10^7$–$5\times10^8$ Pa, more preferably $9\times10^7$–$4\times10^8$ Pa, further preferably $1\times10^8$–$3\times10^8$ Pa. A maximum G" of below $8\times10^7$ Pa may lead to a lower flowability or occurrence of agglomerate after storage of the toner for a long period. A maximum G" in excess of $5\times10^8$ Pa may require a large force for melt-deformation of the toner.

The toner according to the present invention may preferably exhibit a loss tangent (tan δ), i.e., a ratio of loss modulus/storage modulus (G"/G'), of at least 0.5 in a temperature range of 60°–100° C., and a maximum tan δ of at least 1.5 in a temperature range of 63°–78° C. The toner may more preferably show a maximum tan δ in a temperature range of 64°–75° C., further preferably 65°–73° C. In case where the maximum tan δ is found at a temperature below 63° C., the toner may exhibit inferior anti-blocking and anti-offset characteristics. In excess of 78° C., the fixability may be lowered.

The binder resin contained in the toner may preferably show $G'_{100}$ of $5\times10^3$–$1\times10^5$ Pa, more preferably $7\times10^3$–$9\times10^4$ Pa, further preferably $1\times10^4$–$8\times10^4$ Pa. $G'_{100}$ of binder resin below $5\times10^3$ Pa may lead to a lower anti-offset characteristic of the toner, and $G'_{100}$ in excess of $1\times10^5$ Pa may lead to a lower fixability of the toner.

The binder resin used in the toner according to the present invention may preferably be in the form of a resin composition comprising a high-modulus resin component having $G'_{100}$ of $1\times10^4$–$1\times10^6$ Pa and a low-modulus resin component having $G'_{100}$ of below $1\times10^4$ Pa.

The $G'_{100}$ of the high-modulus resin component may preferably be $1\times10^4$–$1\times10^6$ Pa, more preferably $1.5\times10^4$–$8\times10^5$ Pa. Below $1\times10^4$ Pa, the resultant toner may have a low anti-offset characteristic. Above $1\times10^6$ Pa, the resultant toner may have a lower fixability, and the uniform mixing of the high-modulus and low-modulus resin components may become difficult in some cases.

The low-modulus resin component may preferably have $G'_{100}$ of below $1\times10^4$ Pa, more preferably $1\times10^2$–$9\times10^3$ Pa, further preferably $5\times10^2$–$8\times10^3$ Pa. If $G'_{100}$ is $1\times10^4$ Pa or higher, the resultant toner may have a low fixability. Below $1\times10^2$ Pa, the resultant toner may have a low anti-offset characteristic and the uniform mixing of the high-modulus and low-modulus resin components may become difficult.

In the case where the binder resin is in the form of a resin composition comprising a high-modulus resin component and a low-modulus resin component as described above, these resin components may preferably be mixed in weight percentages of 90:10–10:90, more preferably 80:20–15:85, further preferably 70:30–20:80. If the high-modulus resin component in the binder resin is below 10 wt. %, the resultant toner may have a low anti-offset characteristic and, above 90 wt. %, the toner may have a low fixability.

The binder resin in the toner may preferably comprise a polyester resin or a vinyl resin.

The polyester resin preferably used in the present invention may have a composition as described below.

The polyester resin used in the present invention may preferably comprise 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

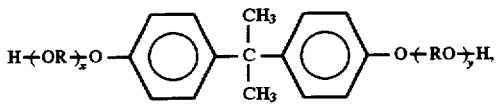

(A)

wherein R denotes an ethylene or propylene group, x and y are independently 0 or a positive integer with the proviso that the average of x+y is in the range of 0–10; diols represented by the following formula (B):

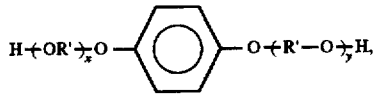

(B)

wherein R' denotes

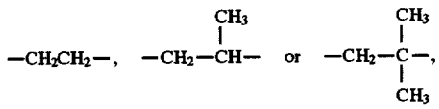

x' and y' are independently 0 or a positive integer with the proviso that the average of x'+y' is in the range of 0–10.

Examples of the dibasic acid constituting at least 50 mol. % of the total acid may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid and itaconic acid, and their anhydrides.

Examples of polyhydric alcohols may include: glycerin, pentaerythritol, sorbitol, sorbitan, and oxyalkylene ethers of novolak-type phenolic resin. Examples of polybasic carboxylic acids having three or more functional groups may include: trimellitic acid, pyromellitic acid, benzophenonetetracarboxylic acid, and their anhydride.

An especially preferred class of alcohol components constituting the polyester resin is a bisphenol derivative represented by the above formula (A), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride. Preferred examples of crosslinking components may include trimellitic anhydride, benzophenonetetracarboxylic acid, pentaerythritol, and oxyalkylene ether of novolak-type phenolic resin.

The polyester resin may preferably have a glass transition temperature of 40°–90° C., particularly 45°–85° C., a number-average molecular weight (Mn) of 1,000–50,000, more preferably 1,500–20,000, particularly 2,500–10,000, and a weight-average molecular weight (MW) of $3\times10^3$–$3\times10^6$, more preferably $1\times10^4$–$2.5\times10^6$ further preferably $4.0\times10^4$–$2.0\times10^6$.

Examples of a vinyl monomer to be used for providing the vinyl resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride: vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; esters of the below-mentioned α,β-unsaturated acids and diesters of the below-mentioned dibasic acids.

Examples of an acid value-providing or carboxy group-containing monomer may include: unsaturated dibasic acids, such as maleic acid, citraconic acid, iraconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, monomethyl alkenylsuccinate, monomethyl fumarate, and monomethyl mesaconate; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids.

It is also possible to use a hydroxyl group-containing monomer: inclusive of acrylic or methacrylic acid esters, such as 2-hydroxyethyl acrylate, and 2-hydroxyethyl methacrylate; 4-(1-hydroxy-1- methylbutyl)styrene, and 4-(1-hydroxy-1-methylhexyl)styrene.

The vinyl resin may have a glass transition point of 45°–80° C., preferably 55°–70° C., a number-average molecular weight (Mn) of $2.5\times10^3$–$5\times10^4$, preferably $3\times10^3$–$2\times10^4$, and a weight-average molecular weight (Mw) of $1\times10^4$–$1.5\times10^6$, preferably $2.5\times10^4$–$1.25\times10^6$.

It is preferred that the toner binder resin has a molecular weight distribution measured by gel permeation chromatography of a soluble content thereof (i.e., a filtrate from a solution thereof in a solvent, such as tetrahydrofuran (THF)) such that it provides peaks at least in a molecular weight region of $2\times10^3$–$4\times10^4$, preferably $3\times10^3$–$3\times10^4$, more preferably $3.5\times10^3$–$2\times10^4$, and in a molecular weight region of $5\times10^4$–$1.2\times10^6$, preferably $8\times10^4$–$1.1\times10^6$, more preferably $1.0\times10^5$–$1.0\times10^6$.

As another preferred mode, the binder resin may preferably provide a molecular weight distribution such that a molecular weight region of at most $4.5\times10^4$ and a region of a larger molecular weight provide an areal ratio of 1:9–9.5:0.5, preferably 2:8–9:1, further preferably 3:7–8.5:1.5.

Examples of the wax contained in the toner may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, sasol wax, montanic acid ester wax, and partially or totally deacidified aliphatic esters, such as deacidified carnauba wax. Further examples of the release agent may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, behenyl alcohol, ceryl alcohol, and melissyl alcohol; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, and ethylene-biscaprylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

A wax preferably used in the present invention is one allowing the toner according to the present invention to more clearly exhibit the characteristic rheological properties. The toner containing such a wax may preferably be one providing a DSC curve (as measured by using a DSC (differential scanning calorimeter)) including a heat-absorption main peak in a temperature region of 60°–135° C., more preferably 60°–100° C., in view of the low-temperature fixability and anti-offset characteristic of the toner. It is further preferred that the wax-containing toner provides a DSC curve including a heat-absorption main peak and a heat-absorption sub-peak or shoulder in a temperature region of 60°–135° C. in view of the low-temperature fixability, anti-offset characteristic and anti-blocking characteristic.

In order to provide a DSC curve of a toner showing a clear heat-absorption peak in the temperature region of 60°–135° C., the wax to be used is limited. If the melting point of a wax is defined as a temperature giving a maximum heat-absorption peak on a DSC curve of the wax measured by using a differential scanning calorimeter in a manner described hereinafter, it is preferred to use a wax having a melting point of 60°–135° C. It is also preferred that the wax is functionally separated in order to provide improved low-temperature fixability and anti-high temperature offset characteristic. For this reason, it is preferred to use a wax composed of at least two types of components including a low-melting point wax component having a relatively low melting point and a high-melting point wax component having a relatively high melting point. More specifically, the low-melting point wax component may preferably have a melting point in the range of 60°–94° C., more preferably 70°–90° C. The high-melting point wax component may preferably have a melting point in the range of 95°–135° C., more preferably 95°–130° C., further preferably 100°–130° C.

In case where the low-melting point wax component has a melting point below 60° C., the resultant toner can have a $G'_{100}$ below $1\times10^4$ Pa, leading to a lower anti-blocking characteristic. In case where the high-melting point wax component has a melting point in excess of 135° C., the toner can have a $G'_{60}/G'_{70}$ ratio below 30, leading to an inferior low-temperature fixability of the toner.

By using such low-melting point wax component and high-melting point wax component in combination, it is possible to provide the above-mentioned heat-absorption main peak and/or heat-absorption sub-peak or shoulder on a DSC curve of a toner.

It is further preferred to use a wax comprising a low-melting point wax component and a high-melting point wax component satisfying the following conditions:

$$80°\ C. \leqq (T_{ML}+T_{MH})/2 \leqq 110°\ C.,$$

and $$T_{MH}-T_{ML} \geqq 20°\ C.,$$

wherein $T_{ML}$ denotes a melting point of the low-melting point wax component, and $T_{MH}$ denotes a melting point of the high-melting point wax component. It is further preferred to satisfy:

$$20°\ C. \leqq T_{MH}-T_{ML} \leqq 75°\ C.$$

The wax used in the toner according to the present invention may preferably comprise the low-melting point wax component and the high-melting point wax component in a weight ratio of 1/19–9/1, more preferably 1/9–8/1, further preferably 1/7–7/1.

By satisfying the above-mentioned mixing ratio, the resultant toner may be provided with further improved low-temperature fixability, anti-blocking characteristic and anti-offset characteristic through contributions of the low-melting point wax component and the high-melting point wax component.

In addition to the low-melting point wax component, it is possible to incorporate another third wax component within an extent of not hindering the effect of the present invention and so as to slightly adjust the low-temperature fixability, anti-blocking characteristic or anti-offset characteristic. Such another wax component should preferably be used in an amount of at most 20 wt. %, if used, and should preferably have a melting point in the range of 60°– 140° C.

In the toner, such a wax may preferably be used in a proportion of 1–20 wt. parts, more preferably 2–17 wt. parts, further preferably 3–15 wt. parts, per 100 wt. parts of the binder resin. By using the wax in such a proportion, it becomes possible to provide the toner with improved low-temperature fixability, anti-blocking characteristic and anti-offset characteristic, and also to reduce the amount of wax particles isolated from the toner particles.

A preferred class of the low-melting point wax component used in the present invention may include aliphatic hydrocarbon waxes having a long-chain alkyl group with little branching. Specific examples thereof may include, e.g., a low-molecular weight alkylene polymer wax obtained through polymerization of an alkylene by radical polymerization under a high pressure or in the presence of a Ziegler catalyst under a low pressure; an alkylene polymer obtained by thermal decomposition of an alkylene polymer of a high molecular weight; and a hydrocarbon wax obtained by subjecting a mixture gas containing carbon monoxide and hydrogen to the Arge process to form a polymethylene hydrocarbon mixture and distilling the hydrocarbon mixture to recover a residue, optionally followed by hydrogen addition. Fractionation of hydrocarbon wax may preferably be performed by the press sweating method, the solvent method, vacuum distillation or fractionating crystallization. As the source of the hydrocarbon wax, it is preferred to use polymethylene waxes as obtained through synthesis from a mixture of carbon monoxide and hydrogen in the presence of a metal oxide catalyst (generally a composite of two or more species), and waxes synthesized by the Synthol process, the Hydrocol process (using a fluidized catalyst bed), and the Arge process (using a fixed catalyst bed) providing a product rich in waxy hydrocarbon.

The above-mentioned long-chain alkyl group can have a terminal portion substituted with a hydroxyl group or a functional group derived from a hydroxyl group, such as carboxyl group, ester group, ethoxy group or sulfonyl group. A long-chain alkyl alcohol may be produced as follows. Ethylene is polymerized in the presence of a Ziegler catalyst and, after the polymerization, oxidized to provide an alkoxide of the catalyst metal and polyethylene, which is then hydrolyzed to provide an objective long-chain alkyl alcohol. The thus prepared long-chain alkyl alcohol has little branching and a sharp molecular weight distribution and is suitably used in the present invention.

A preferred class of the high-melting point wax component used in the present invention may include aliphatic hydrocarbon waxes having a long-chain alkyl group with little branching. Specific examples thereof may include, e.g., a low-molecular weight alkylene polymer wax obtained through polymerization of an alkylene by radical polymerization under a high pressure or in the presence of a Ziegler catalyst under a low pressure; an alkylene polymer obtained by thermal decomposition of an alkylene polymer of a high molecular weight; and a hydrocarbon wax obtained by subjecting a mixture gas containing carbon monoxide and hydrogen to the Arge process to form a polymethylene hydrocarbon mixture and distilling the hydrocarbon mixture to recover a residue, optionally followed by hydrogen addition. Fractionation of hydrocarbon wax may preferably be performed by the press sweating method, the solvent method, vacuum distillation or fractionating crystallization. As the source of the hydrocarbon wax, it is preferred to use polymethylene waxes as obtained through synthesis from a mixture of carbon monoxide and hydrogen in the presence of a metal oxide catalyst (generally a composite of two or more species), and waxes synthesized by the Synthol process, the Hydrocol process (using a fluidized catalyst bed), and the Arge process (using a fixed catalyst bed) providing a product rich in waxy hydrocarbon.

The above-mentioned long-chain alkyl group can have a terminal portion substituted with a hydroxyl groups or a functional group derive from a hydroxyl group, such as carboxyl group, ester group, ethoxy group or sulfonyl group.

The low-melting point wax component preferably used in the present invention may preferably have a weight-average molecular weight (Mw) of 300–1000, more preferably 350–900 and a ratio Mw/Mn (number-average molecular weight) of at most 2.8, more preferably at most 2.3. The high-melting point wax component may preferably have Mw of 500–15,000, more preferably 650–10,000, further preferably 1,500–9,000, and a ratio Mw/Mn of at most 3.0, more preferably at most 2.5. A wax obtained by combination of the low- and high-melting point wax components satisfying the above conditions may provide the toner with improved low-temperature fixability, anti-blocking characteristic and anti-offset characteristic.

Some preferred combinations of the low- and high-melting point wax components are enumerated below.

(1) Combination of a low-melting point hydrocarbon wax component and a high-melting point hydrocarbon wax component.

The low-melting point hydrocarbon wax component may preferably have a long-chain alkyl group with little branching, a melting point of 70°–90° C., Mw of 400–700, and Mw/Mn of 1.5–2.

The high-melting point hydrocarbon wax component may preferably have a long-chain alkyl group with little branching, a melting point of 95°–130° C., Mw of 800–2500, and Mw/Mn of 2–2.5.

(2) Combination of a low-melting point hydrocarbon wax component and a high-melting point substituted-alkyl wax component.

The low-melting point hydrocarbon wax component may preferably be one similar to the one used in (1) above.

The high-melting point substituted-alkyl wax component may preferably contain at least 50 wt. % of components having a long-chain alkyl group with little branching and including an intra-molecular or terminal substituent group other than hydrogen of preferably hydroxyl and/or carboxyl. The high-melting point substituted-alkyl wax component may preferably have a melting point of 95°–130° C., Mw=800–5000, and Mw/Mn=1.5–2.5.

(3) Combination of a low-melting point substituted-alkyl wax component and a high-melting point hydrocarbon wax component.

The low-melting point substituted-alkyl wax component may preferably contain at least 40 wt. % of components having a long-chain alkyl group with little branching and including an intra-molecular or terminal substituent group other than hydrogen of preferably hydroxyl and/or carboxyl. The high-melting point substituted-alkyl wax component may preferably have a melting point of 70°–90° C., Mw=400–700, and Mw/Mn=1.5–2.5.

The high-melting point hydrocarbon wax component may preferably be one similar to the one used in (1) above.

(4) Combination of a low-melting point substituted-alkyl wax component and a high-melting point substituted alkyl wax component.

The low-melting point substituted-alkyl wax component may be one similar to the one used in (3) above.

The high-melting point substituted-alkyl wax component may be one similar to the one used in (2) above.

Some preferred examples of combination of binder resins used in the present invention are enumerated below.

(1) Combination of a low-modulus vinyl resin and a high-modulus vinyl resin:

The low-modulus vinyl resin may preferably have Mw=5,000–50,000, Mw/Mn=1.5–20, and $1\times10^2$ Pa$\leqq G'_{100}<1\times10^4$ Pa.

The high-modulus vinyl resin may preferably have Mw=$3\times10^4$–$1.5\times10^6$ Mw/Mn=1.5–20, and $G'_{100}=1\times10^4$–$1\times10^6$ Pa.

(2) Combination of a low-modulus polyester resin and a high-modulus polyester resin.

The low-modulus polyester resin may preferably have Mw=2000–30,000, Mw/Mn=1.5–20, and $1\times10^2$ Pa$\leqq G'_{100}\leqq1\times10^4$ Pa.

The high-modulus polyester resin may preferably have Mw=$4\times10^4$–$1\times10^6$ Mw/Mn=1.5–20, and $G'_{100}=1\times10^4$–$1\times10^6$ Pa.

(3) Combination of a low-modulus vinyl resin and a high-modulus polyester resin

The low-modulus vinyl resin of (1) above and the high-modulus polyester resin of (2) above may be used in combination.

(4) Combination of a low-modulus vinyl resin and a high-modulus polyester resin

The low-modulus polyester resin of (2) above and the high-modulus vinyl resin of (1) above may be used in combination.

In the combinations of binder resins described in (1)–(4) above, it is also possible to add a third resin component within an extent of not hindering the effect of the present invention. Such a third resin component may be a vinyl resin, a polyester resin or another type of resin produced through a different process, and the addition amount thereof should preferably be suppressed to at most 30 wt. % or less.

In order for the toner according to the present invention to exhibit the prescribed rheological properties, it is important to appropriately select and combine the binder resins and the wax(es), and further to appropriately mix these materials. Even if the binder resins and the wax(es) are appropriately selected, if these materials are mixed in an inappropriate method, it is difficult to attain the expected good rheological properties.

Methods for mixing a binder resin and a wax preferably used for producing the toner according to the present invention will be described below.

In order to obtain a toner according to the present invention exhibiting characteristic viscoelastic properties, the low-modulus binder resin, high-modulus binder resin, high-melting point wax component and low-melting point wax component may be used in combination and mixed according to various manners.

In a general term, the respective waxes pulverized, the binder resin, colorant (or magnetic material), and other optional additives may be blended by a blender, such as a Henschel mixer, and then melt-kneaded to effect the mixing. It is possible to melt-knead the low-melting point wax component, the high-melting point wax component and an optional third wax component in advance. The melt-kneaded wax mixture may be then added to and mixed with the binder resin(s). As another method of wax addition, the binder resin(s) may be dissolved in an organic solvent under heating, and the wax is added to the solution, followed by evaporation of the solvent to dryness. Alternatively the binder resin(s) may be hot-melted without using an organic solvent and then the wax may be added thereto. As another method of wax addition, the wax may be added in a step of synthesizing the binder resin(s). Also in this case, the wax components may be melt-kneaded in advance. As another method of wax addition, only the low-melting point wax component may be added to the binder resin(s) in advance. More specifically, this may be effected by melt-kneading only the binder resin(s) and then adding the low-melting point wax component thereto; by dissolving the binder resin(s) in an organic solvent under heating, adding thereto the low-melting point wax component and drying the mixture by evaporating the organic solvent; and by adding the low-melting point wax in a step of synthesizing the binder resin(s). In this case, the high-melting point wax component may be added to the toner by blending it with the binder resin(s) containing the low-melting point wax component, the colorant (magnetic material), etc., and melt-kneading the blend.

In the toner for developing electrostatic images according to the present invention, it is possible to add a charge control agent, as desired, in order to further stabilize the chargeability thereof. The charge control agent may be used in 0.1–10 wt. parts, preferably 0.1–5 wt. parts, per 100 wt. parts of the binder resin.

Examples of the charge control agents may include organometal complexes, chelate compounds and organic metal salts, inclusive of mono-azo metal complexes, metal complexes or metal salts of aromatic hydroxycarboxylic acids and aromatic dicarboxylic acid compounds. Other examples may include: aromatic hydroxycarboxylic acids, aromatic mono- and polycarboxylic acids, anhydrides and esters of these acids, and phenol derivatives of bisphenols.

When the toner according to the present invention is constituted as a magnetic toner, the magnetic toner may contain a magnetic material, examples of which may include: iron oxides, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or $\gamma$-diiron trioxide.

The magnetic material may have an average particle size (Dav.) of 0.1–2 μm, preferably 0.1–0.5 μm. The magnetic material may preferably show magnetic properties when measured by application of 10 kilo-Oersted, inclusive of: a coercive force (Hc) of 20–150 Oersted, a saturation magnetization ($\sigma s$) of 50–200 emu/g, particularly 50–100 emu/g, and a residual magnetization ($\sigma r$) of 2–20 emu/g.

The magnetic material may be contained in the toner in a proportion of 10–200 wt. parts, preferably 20–150 wt. parts, per 100 wt. parts of the binder resin.

The toner according to the present invention may also contain a non-magnetic colorant, examples of which may include: carbon black, titanium white, and other pigments and/or dyes. For example, the toner according to the present invention, when used as a color toner, may contain a dye, examples of which may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6. Examples of the pigment may include: Mineral Fast Yellow, Navel Yellow, Naphthol Yellow S, Hansa Yellow G, Permanent Yellow NCG, Tartrazine Lake, Molybdenum Orange, Permanent Orange GTR, Pyrazolone Orange, Benzidine Orange G, Cadmium Red, Permanent Red 4R, Watching Red Ca salt, eosine lake; Brilliant Carmine 3B; Manganese Violet, Fast Violet B, Methyl Violet Lake, Cobalt BLue, Alkali Blue Lake, Victoria Blue Lake, Phthalocyanine Blue, Fast Sky Blue, Indanthrene Blue BC, Chrome Green, chromium oxide, Pigment Green B, Malachite Green Lake, and Final Yellow Green G.

Examples of the magenta pigment may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

The pigments may be used alone but can also be used in combination with a dye so as to increase the clarity for providing a color toner for full color image formation. Examples of the magenta dyes may include: oil-soluble dyes, such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28.

Other pigments include cyan pigments, such as C.I. Pigment Blue 2, 3, 15, 16, 17; C.I. Vat Blue 6, C.I. Acid Blue 45, and copper phthalocyanine pigments represented by the following formula and having a phthalocyanine skeleton to which 1–5 phthalimidomethyl groups are added:

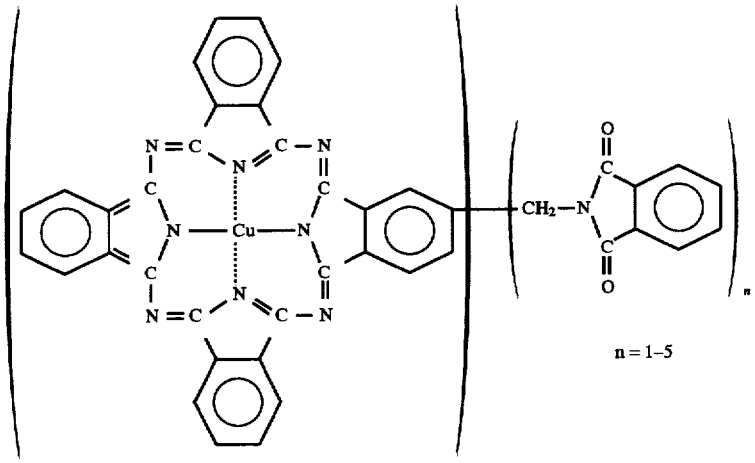

n = 1–5

Examples of yellow pigment may include: C.I. Pigment Yellow 1, 2, 3, 4, 5, 6, 7, 10, 11, 12, 13, 14, 15, 16, 17, 23, 65, 73, 83; C.I. Vat Yellow 1, 13, 20.

Such a non-magnetic colorant may be added in an amount of 0.1–60 wt. parts, preferably 0.5–50 wt. parts, per 100 wt. parts of the binder resin.

A flowability-improving agent may be blended with the toner to improve the flowability of the toner. Examples thereof may include: powder of fluorine-containing resin, such as polyvinylidene fluoride fine powder and polytetrafluoroethylene fine powder; fine powdery silica such as wet-process silica and dry-process silica, fine powdery titanium oxide and fine powdery alumina and treated silica, treated titanium oxide or treated alumina obtained by surface-treating (hydrophobizing) such fine powdery silica, fine powdery titanium oxide or fine powdery alumina with silane coupling agent, titanium coupling agent, silicone oil, etc.

A preferred class of the flowability-improving agent includes dry process silica or fumed silica obtained by vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

It is preferred to use fine silica powder having an average primary particle size of 0.001–2 μm, particularly 0.002–0.2 μm.

Commercially available fine silica powder formed by vapor phase oxidation of a silicon halide to be used in the present invention include those sold under the trade names as shown below.

| | |
|---|---|
| AEROSIL<br>(Nippon Aerosil Co.) | 130<br>200<br>300<br>380 |

-continued

| | |
|---|---|
| | OX 50<br>TT 600<br>MOX 80<br>COK 84 |
| Cab-O-Sil<br>(Cabot Co.) | M-5<br>MS-7<br>MS-75<br>HS-5<br>EH-5 |
| Wacker HDK<br>(WACKER-CHEMIE GMBH) | N 20<br>V 15<br>N 20E<br>T 30<br>T 40 |
| D-C Fine Silica<br>(Dow Corning Co.)<br>Fransol<br>(Fransil Co.) | |

It is further preferred to use treated silica fine powder obtained by subjecting the silica fine powder formed by vapor-phase oxidation of a silicon halide to a hydrophobicity-imparting treatment. It is particularly preferred to use treated silica fine powder having a hydrophobicity of 30–80 as measured by the methanol titration test.

Silica fine powder may be imparted with a hydrophobicity by chemically treating the powder with an organosilicone compound, etc., reactive with or physically adsorbed by the silica fine powder.

Example of such an organosilicone compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units, and further silicone oils, such as dimethyl silicone oil. These may be used alone or as a mixture of two or more compounds.

It is also possible to use a flowability-improving agent by treating the above-mentioned dry-process silica with an amino group-containing silane coupling agent or silicone oil as shown below:

$H_2NCH_2CH_2CH_2Si(OCH_3)_3$ $H_2NCH_2CH_2CH_2Si(OC_2H_5)_3$ $H_2NCH_2CH_2CH_2Si(CH_3)(OCH_3)_2$ $H_2NCH_2CH_2NHCH_2CH_2CH_2Si(CH_3)(OCH_3)_2$ $H_2NCONHCH_2CH_2CH_2Si(OC_2H_5)_3$ $H_2NCH_2CH_2NHCH_2CH_2CH_2Si(OCH_3)_3$ $H_2NCH_2CH_2NHCH_2CH_2NHCH_2CH_2CH_2Si(OCH_3)_3$ $H_3C_2OCOCH_2CH_2NHCH_2CH_2CH_2Si(OCH_3)_3$ $H_5C_2OCOCH_2CH_2NHCH_2CH_2NHCH_2CH_2CH_2Si(OCH_3)_3$ $H_5C_2OCOCH_2CH_2NHCH_2CH_2NHCH_2CH_2NHCH_2CH_2NHCH_2CH_2CH_2Si(OCH_3)_3$ $H_3COCOCH_2CH_2NHCH_2CH_2NHCH_2CH_2CH_2Si(OCH_3)_3$ $(H_5C_2)_2N-CH_2CH_2CH_2Si(OCH_3)_3$

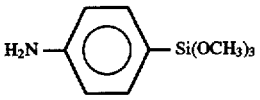

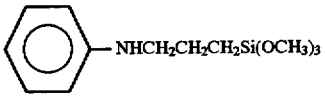

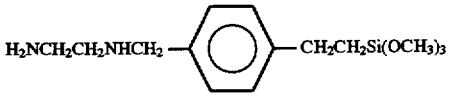

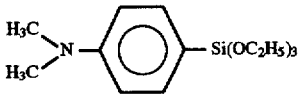

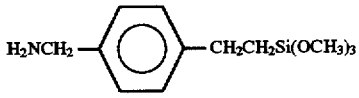

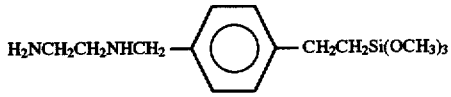

$(HOCH_2CH_2)_2N-CH_2CH_2CH_2Si(OCH_3)_3$ $(H_2CO)_3SiCH_2CH_2CH_2-NHCH_2$ $(H_5C_2O)_3SiCH_2CH_2CH_2)_2NH$ $H_2CNHCH_2CH_2CH_2Si(OC_2H_5)_3$ $H_2N(CH_2CH_2NH)_2CH_2CH_2CH_2Si(OCH_3)_3$ $H_3C-NHCONHC_3H_6Si(OCH_3)_3$

As a silicone oil, it is possible to use an amino-modified silicone oil having a partial structure including an amino group in its side chain as shown below:

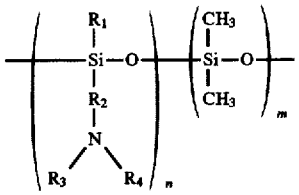

wherein $R_1$ denotes hydrogen, alkyl group, aryl group or alkoxy group; $R_2$ denotes alkylene group or phenylene group; $R_3$ and $R_4$ denote hydrogen, alkyl group or aryl group with the proviso that the alkyl group, aryl group, alkylene group and/or phenylene group can contain an amino group or another substituent, such as halogen, within an extent of not impairing the chargeability. m and n denote a positive integer.

Commercially available examples of the amino group-containing silicone oil may include the following:

| Trade name (Maker) | Viscosity at 25° C. (cPs) | Amine equivalent |
|---|---|---|
| SF8417 (Toray Silicone K.K.) | 1200 | 3500 |
| KF393 (Shin'Etsu Kagaku K.K.) | 60 | 360 |
| KF857 (Shin'Etsu Kagaku K.K.) | 70 | 830 |
| KF860 (Shin'Etsu Kagaku K.K.) | 250 | 7600 |
| KF861 (Shin'Etsu Kagaku K.K.) | 3500 | 2000 |
| KF862 (Shin'Etsu Kagaku K.K.) | 750 | 1900 |
| KF864 (Shin'Etsu Kagaku K.K.) | 1700 | 3800 |
| KF865 (Shin'Etsu Kagaku K.K.) | 90 | 4400 |
| KF369 (Shin'Etsu Kagaku K.K.) | 20 | 320 |
| KF383 (Shin'Etsu Kagaku K.K.) | 20 | 320 |
| X-22-3680 (Shin'Etsu Kagaku K.K.) | 90 | 8800 |
| X-22-380D (Shin'Etsu Kagaku K.K.) | 2300 | 3800 |
| X-22-3801C (Shin'Etsu Kagaku K.K.) | 3500 | 3800 |
| X-22-3810B (Shin'Etsu Kagaku K.K.) | 1300 | 1700 |

The amine equivalent refers to a g-equivalent per amine which is equal to a value of the molecular weight of an amino group-containing silicone oil divided by the number of amino groups in the silicone oil.

The flowability-improving agent may have a specific surface area of at least 30 $m^2/g$, preferably 50 $m^2/g$, as measured by the BET method according to nitrogen adsorption. The flowability-improving agent may be used in an amount of 0.01–8 wt. parts, preferably 0.1–4 wt. parts, per 100 wt. parts of the toner.

The toner according to the present invention may be prepared by sufficiently blending the binder resin(s), the wax, a magnetic or non-magnetic colorant, and a charge control agent or other additives, as desired, by a blender such as a Henschel mixer or a ball mill, followed by melt-kneading for mutual dissolution of the resins of the blend, cooling for solidification of the kneaded product, pulverization and classification to recover a toner product.

The toner according to the present invention may preferably have a weight-average particle size of 3–9 μm, more preferably 3–8 μm, so as to provide high resolution and image density, and even such a small-particle size toner can be well fixed under application of heat and pressure.

The toner may be further sufficiently blended with an external additive such as a flowability-improving agent having a chargeability to a polarity identical to that of the toner by a blender such as a Henschel mixer to obtain a toner according to the present invention, wherein the external additive is carried on the surface of the toner particles.

Rheological properties and other physical properties characterizing the toner according to the present invention are based on values measured according to the following methods. ps (1) Rheological properties of toners and binder resins Measurement is performed by using a visco-elasticity measurement apparatus ("Rheometer RDA-II", available from Rheometrics Co.).

Shearing means: Parallel plates having diameters of 7.9 mm for a high-modulus sample or 25 mm for a low-modulus sample.

Measurement sample: A toner or a binder resin is heat-melted and then molded into a cylindrical sample having a diameter of ca. 7.9 mm and a height of 2–5 mm or a disk sample having a diameter of ca. 25 mm and a thickness of 2–3 mm.

Measurement frequency: 6.28 radian/sec.

Setting of measurement strain: Initial value is set to 0.1%, and the measurement is performed according to an automatic measurement mode.

Correction for sample elongation: Performed by an automatic measurement mode.

Measurement temperature: Increased at a rate of 1° C./min, from 25° C. to 150° C.

An example of measurement results is shown in FIG. 1.

(2) Melting point of waxes

Measurement is performed by using a differential scanning calorimeter ("DSC-7", available from Perkin-Elmer Corp.) according to ASTM D-3418-82.

A sample in an amount of 2–10 mg, preferably ca. 5 mg, is accurately weighed.

The sample is placed on an aluminum pan and subjected to measurement in a temperature range of 30°–200° C. at a temperature-raising rate of 10° C./min in a normal temperature/normal humidity environment.

In the course of temperature increase, a main peak of heat absorption appears on a DSC curve at a temperature in the range of 30°–200° C., and the temperature is taken as the melting point of the wax sample.

(3) DSC curve of a toner

A DSC cure of a toner in a temperature-raising stage is obtained in a similar manner as the above-mentioned melting point measurement for a wax.

(4) Glass transition temperature (Tg) of binder resin

Measurement may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed.

The sample is placed on an aluminum pan and subjected to measurement in a temperature range of 30°– 200° C. at a temperature-raising rate of 10° C./min in a normal temperature—normal humidity environment in parallel with a blank aluminum pan as a reference.

In the course of temperature increase, a main absorption peak appears in the temperature region of 40°–100° C.

In this instance, the glass transition temperature is determined as a temperature of an intersection between a DSC curve and an intermediate line passing between the base lines obtained before and after the appearance of the absorption peak.

(5) Molecular weight distribution of waxes

The molecular weight (distribution) of a wax may be measured by GPC (gel permeation chromatography) under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

(6) Molecular weight distribution of a binder resin material or a binder resin in a toner The molecular weight (distribution) of a binder resin may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min. A sample of a binder resin material is once passed through a roll mill (150° C., 15 min.) to be used as a measurement sample. A toner sample is once dissolved in THF and the solution is filtrated through a 0.2 μm-filter to recover the filtrate as a sample. GPC sample solution is prepared in an amount of 50–200 μl and at a concentration of 0.05–0.6 wt. % and is injected into the column. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of μ-styragel 500, $10^3$, $10^4$ and $10^5$ available from Waters Co.; a combination of Shodex KF-801, 802, 803, 804, 805, 806 and 807 available from Showa Denko K.K.

Figure 2:
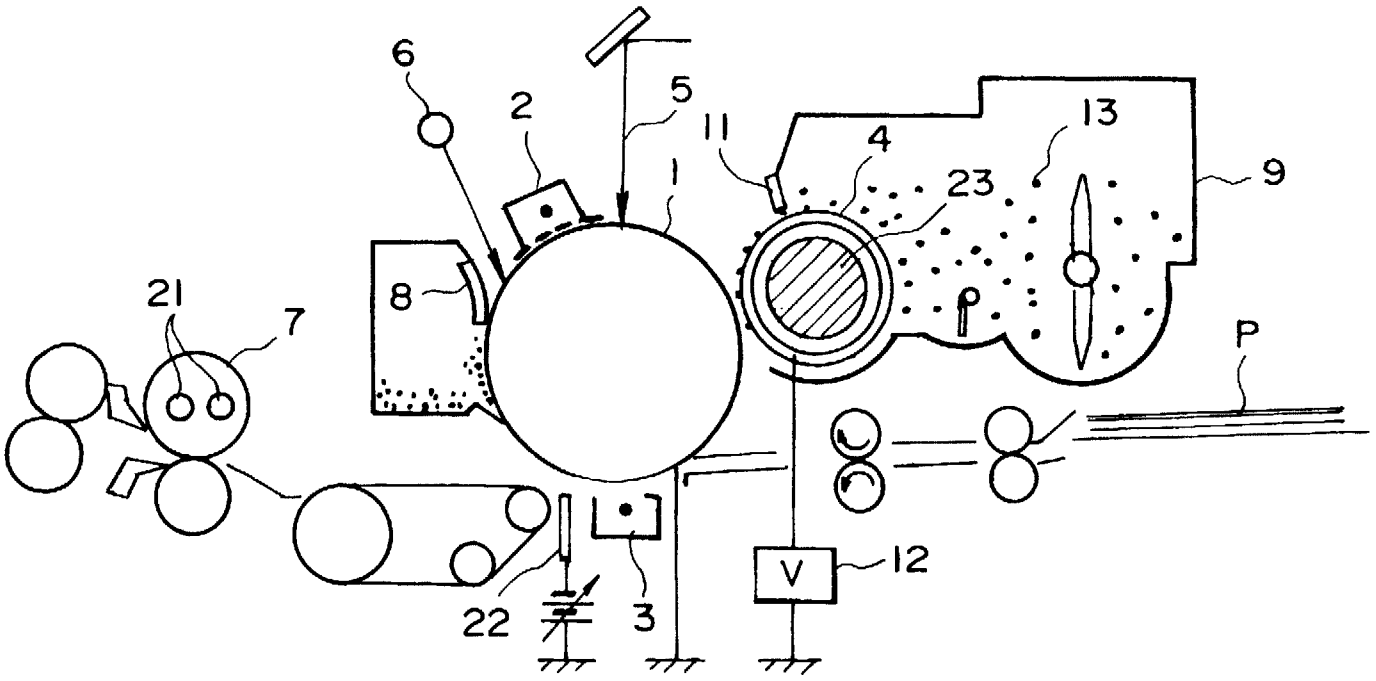
FIG. 2 is a schematic illustration of an image forming apparatus to which the toner according to the present invention is applicable.

An example of an image forming apparatus to which the toner according to the present invention is applicable will now be described with reference to FIGS. 2 and 3. The surface of an electrostatic image-bearing member (photosensitive member) 1 is negatively or positively charged by a primary charger 2 and exposed to light image by analog exposure or scanning with a laser beam 5 to form an electrophotographic image thereon (e.g., digital latent image). The electrostatic image is developed with a magnetic toner 13 contained in a developing device 9 equipped with a magnetic blade 11 and a developing sleeve 4 enclosing a magnet 23 having magnetic poles $N_1$, $N_2$, $S_1$ and $S_2$ according to a reversal development mode or a normal development mode. In a developing zone, an alternating bias voltage, a pulse bias voltage and/or a DC bias voltage is applied between an electroconductive substrate 16 of the photosensitive member 1 and the developing sleeve 4 by a bias voltage application means 12. The magnetic toner image formed on the photosensitive member 1 is transferred via an intermediate transfer member (not shown) or directly to a transfer paper P (transfer-receiving material). More specifically, a transfer paper P having reached a transfer zone is charged positively or negatively on its back side (on a side opposite from the photosensitive member 1) by means of a transfer charger 3, whereby the negatively or positively charged magnetic toner image on the photosensitive member 1 surface is electrostatically transferred onto the transfer paper P. Then, after being charge-removed by a discharge means 22, the transfer paper P is separated from the photosensitive member 1, and the toner image thereon is fixed under application of heat and pressure onto the transfer paper P when it is passed through a hot pressure fixing device 7 enclosing a heater 21.

The magnetic toner remaining on the photosensitive member 1 after the transfer stage is removed by cleaning means including a cleaning blade 8. The photosensitive member 1 after the cleaning is subjected to erase exposure by exposure means 6 for charge removal and then again subjected to an image forming cycle as described starting from the charging step using the primary charger.

Figure 3:
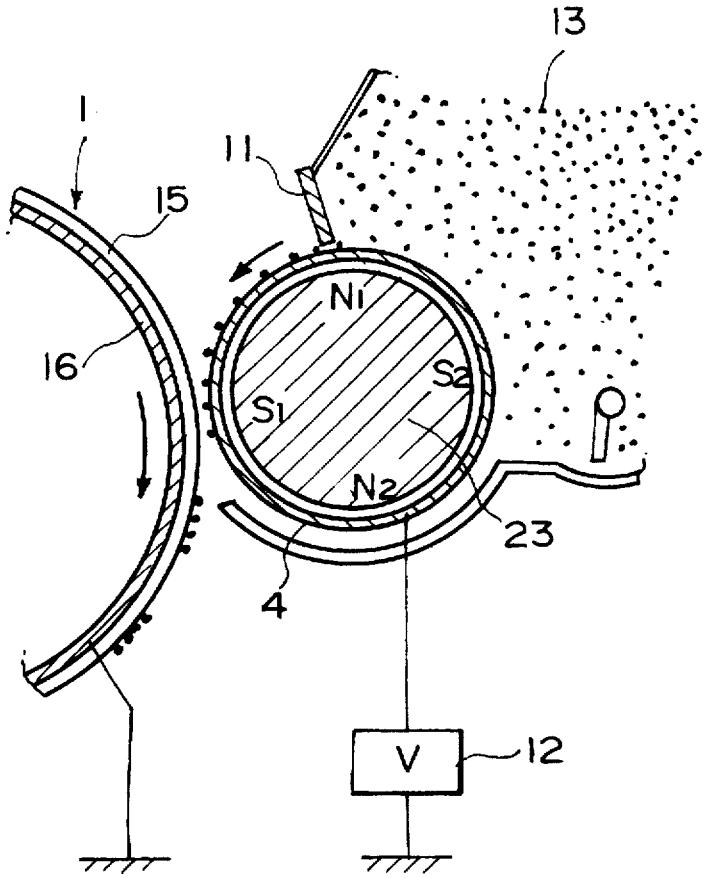
FIG. 3 is an enlarged view of a developing section of the apparatus shown in FIG. 2.

Referring to FIG. 3, the electrostatic image-bearing member (e.g., photosensitive drum) 1 comprises a photosensitive layer 15 and an electroconductive support 16 and rotates in the direction of an arrow. The developing sleeve 4 comprises a non-magnetic cylinder and rotates so as to move in an identical direction as the surface of the electrostatic image-bearing member 1 at the developing zone. Inside the non-magnetic cylindrical sleeve 4, a multi-pole permanent magnet (magnet roll) 23 as a magnetic field-generating means is enclosed so as not to rotate. The magnetic toner 13 in the developing device 9 is applied onto the developing sleeve 4, and the magnetic toner particles and triboelectrically charged through friction with the surface of the developing sleeve 4. An iron-made magnetic doctor blade 11 is disposed in proximity to the surface of the cylindrical developing sleeve 4 (with a spacing of 50–500 μm), thereby forming a magnetic toner layer in a uniformly controlled small thickness (30–300 μm) which is equal to or smaller than the spacing between the photosensitive member 1 and the developing sleeve 4 at the developing zone. The rotation speed of the developing sleeve 4 is to provide a surface speed thereof which is substantially equal to or close to the surface speed of the photosensitive member 1. The magnetic doctor blade 11 may be formed of a permanent magnet instead of iron so as to form a counter magnetic pole. At the developing zone, the developing sleeve 4 may be supplied with an AC bias or pulse bias voltage by the bias voltage application means. The AC bias voltage may have a frequency (f) of 200–4000 Hz and a peak-to-peak voltage (Vpp) of 500–3000 volts.

At the developing zone, the magnetic toner particles are transferred toward the electrostatic image side under the action of an electrostatic force exerted by the photosensitive member surface and the AC or pulse bias voltage.

The magnetic iron blade 11 can be replaced by an elastic blade formed by an elastic material, such as silicone rubber, so as to apply the magnetic toner on the developing sleeve and regulate the magnetic toner layer thickness by a pressing force.

Hereinbelow, the present invention will be described based on Examples.

EXAMPLE 1

A toner was prepared from the following materials (a)–(f).

(a) Low modulus binder resin 70 wt.parts (Styrene-butyl acrylate copolymer prepared by solution polymerization; Tg=62.1° C., Mw=12,300, Mw/Mn=2.4, $G'_{100}=2.3\times10^3$ Pa)

(b) High-modulus binder resin 30 wt.parts (Styrene-butyl acrylate copolymer prepared by suspension polymerization; Mw=793,600, Mw/Mn=2.1, Tg=60.7° C., $G'_{100}=1.7\times10^5$ Pa)

(c) Magnetic material 90 wt.parts
(Dav. (average particle size)=0.2 μm)

(d) Mono-azo metal complex 2 wt.parts
(negative charge control agent)

(e) Low-melting point wax 4 wt.parts
(High-purity low-melting point hydrocarbon wax prepared by purifying petroleum wax by the press sweating method; Tmp (melting point)=75° C., Mw=520, Mw/Mn=1.8)

(f) High-melting point wax 3 wt. parts
(High-melting point wax synthesized by the Fischer-Tropsch process; Tmp=108° C., Mw=1080, Mw/Mn=2.0)

The above materials were pre-blended by a Henschel mixer and melt-kneaded through a twin-screw kneading extruder at 130° C. After cooling, the kneaded product was coarsely crushed by a cutter mill and pulverized by a fine pulverizer using a jet air stream, followed by classification to obtain a negatively chargeable insulating magnetic toner having a weight-average particle size (Dw)=6.4 μm. The magnetic toner in 100 wt. parts was blended with 1.0 wt. part of negative chargeable hydrophobic dry-process silica ($S_{BET}$ (BET specific surface area)=300 $m^2/g$) as external additive by mean of a Henschel mixer to obtain Magnetic toner (1).

In order to measure the rheological properties of Magnetic toner (1), the toner was heat-melted and cast into a cylindrical sample having a diameter of ca. 8 mm and a height of 3 mm. The sample was fixed on serrated parallel plates of 7.9 μm in diameter and subjected to measurement of temperature-dependent storage modulus and loss modulus according to an ordinary method. The measurement results are shown in FIG. 1.

The dispersibility of the wax in the toner was evaluated by observing the toner through an optical microscope equipped with a polarizer at a low magnification at ca. 6, whereby only 7–8 bright spots indicating the presence of isolated wax particles were observed with respect to ca. 300 toner particles in the view field, thus sowing a good dispersion state.

The magnetic toner was subjected to $1\times10^5$ sheets of continuous image formation by using a digital copier ("GP-55", available from Canon K.K.).

The digital copier included a photosensitive drum having a 30 mm-dia. aluminum cylinder coated with an OPC photosensitive layer. The photosensitive drum was charged at −700 volts by a primary charger and image-scanned by laser light to form a digital latent image thereon, which was developed by a reversal development mode with the above-prepared negatively chargeable magnetic toner (Magnetic toner (1)) triboelectrically charged on a developing sleeve containing a fixed magnet including four magnetic poles including a developing magnetic pole of 950 gauss.

The developing sleeve was supplied with a DC bias of −600 volts and an AC bias (Vpp=800 volts, f=1800 Hz). The resultant magnetic toner image on the photosensitive member was electrostatically transferred onto plain paper by transfer means. After charge removal and separation from the photosensitive drum of the plain paper, the plain paper carrying the magnetic toner image was passed through hot pressure means including a heating roller and a pressure roller to fix the toner image.

The resultant images showed an image density of 1.33 at the initial stage (1st to 10th sheets) and 1.35 at the end of the $10^5$ sheets of the continuous image formation, thus showing substantially no change. Good image qualities were obtained without causing image quality charges, such as scattering and thickening of line images. After completion of the $10^5$ sheets of continuous image formation, the OPC photosensitive drum surface was observed, whereby the drum surface was found to be accompanied with no attachment of isolated wax or no noticeable damages. The resultant images also showed no image defects attributable to damages on the OPC photosensitive drum.

Then, the fixing device of the digital copier was removed from the copier, and an externally driven fixing device remodeled so as to rotate at a fixing roller speed of 100 mm/min and equipped with a temperature controller so as to vary the fixing roller temperature within the range of 100°–250° C. A fixing test was performed in a thermostat vessel controlled at 3°–5° C. and, after confirming that the fixing device assumed the vessel temperature, power was supplied to the fixing device, so that the fixing test was performed immediately after the heating roller (upper roller) reached 110° C. At that time, the pressure roller (lower roller) assumed a temperature of ca. 70° C. Then, while the heater was energized, the fixing rollers were rotated continually for 20 min. to effect a fixing test, when the pressure roller (lower roller) showed a temperature of ca. 90° C.

As a result of the above-mentioned fixing tests, the resultant fixed images showed a density decrease of 18% immediately after the power supply and a density decrease of 13% after 20 min., thus showing levels of practically of no problem. When the toner was left standing for 7 days in a thermostat vessel controlled at 50° C. to effect an anti-blocking test, the resultant toner showed slight agglomeration which however could be easily disintegrated to recover good flowability.

The toner showed a glass transition temperature (Tg) which was substantially not lower than that of the binder resins and a DSC curve showing heat-absorption peaks corresponding to those of the low-melting point wax and the high-melting point wax when these waxes alone were subjected to DSC measurement.

EXAMPLE 2

Magnetic toner (2) was prepared in the same manner as in Example 1 except for using a binder resin prepared by dissolving the low-modulus binder resin and the high-modulus binder resin in an organic solvent for uniform mixing and distilling off the organic solvent. The magnetic toner was subjected to evaluation of image density, fixability and rheological properties in the same manner as in Example 1. The results are shown in Table 1.

EXAMPLE 3

Magnetic toner (3) was prepared in the same manner as in Example 1 except for using a uniform mixture of the low-melting point wax and the high-melting point wax prepared through melt-mixing and the binder resin mixture prepared in Example 2. The results of evaluation of the magnetic toner including the rheological properties thereof are shown in Table 1.

EXAMPLE 4

Magnetic toner (4) was prepared in the same manner as in Example 1 except for using the binder resin mixture prepared in the same manner as in Example 2 but adding simultaneously thereto the melt-mixture wax of Example 3. The evaluation results are also shown in Table 1.

EXAMPLE 5

Magnetic toner (5) was prepared in the same manner as in Example 4 by using the same high-modulus binder resin, low-melting point wax and high-melting point wax but replacing the low-modulus binder resin with the following one.

Low-modulus binder resin (Styrene-acrylic acid copolymer prepared by solution polymerization; Tg=59.3° C., Mw=8,800, Mw/Mn=2.3, $G'_{100}=9.2\times10^2$ Pa).

The magnetic toner was evaluated in the same manner as in Example 1. The results are also shown in Table 1.

EXAMPLE 6

Magnetic toner (6) was prepared in the same manner as in Example 5 by using the same low-modulus binder resin, low-melting point wax and high-melting point wax but replacing the high-modulus binder resin with the following one.

High-modulus binder resin (Styrene-acrylic acid copolymer prepared by suspension polymerization; Tg=59.4° C., Mw=573,000, Mw/Mn=1.9, $G'_{100}=8.8\times10^4$ Pa).

The magnetic toner was evaluated in the same manner as in Example 1. The results are also shown in Table 1.

EXAMPLE 7

Magnetic toner (7) was prepared in the same manner as in Example 1 except for using the following polyester resins and waxes in the indicated amounts.

Low-modulus binder resin 40 wt.parts
(Polyester prepared from fumaric acid, bisphenol propoxy-adduct and trimellitic anhydride; Tg=63.3° C., Mw=6,700, Mw/Mn=2.3, $G'_{100}=1.7\times10^2$ Pa)

High-modulus binder resin 60 wt.parts
(Polyester prepared from terephthalic acid, fumaric acid, trimellitic anhydride, bisphenol propoxy-adduct and bisphenol ethoxy-adduct; Tg=61.2° C., Mw=43,200, Mw/Mn=5.1, $G'_{100}=3.6\times10^4$ Pa)

Low-melting point wax 3 wt.parts
(Low-melting point hydrocarbon wax; Tmp=69° C., Mw=410, Mw/Mn=1.6)

High-melting point wax 4 wt.parts
(High-melting point long-chain alkyl alcohol wax; Tmp=103° C., Mw=980, Mw/Mn=1.8)

The evaluation results are shown in Table 1.

EXAMPLE 8

Magnetic toner (8) was prepared in the same manner as in Example 7 except for using a binder resin-wax uniform mixture prepared by heat-melting the low-modulus binder resin and adding thereto the low-melting point wax and the high-melting point wax. The evaluation results are shown in Table 1.

EXAMPLE 9

Magnetic toner (9) was prepared in the same manner as in Example 7 except for using a uniform melt-mixture product of the low-melting point wax and the high-melting point wax. The evaluation results are shown in Table 1.

EXAMPLE 10

Magnetic toner (10) was prepared in the same manner as in Example 9 except for using the following high-modulus binder resin. The evaluation results are shown in Table 1.

High-modulus binder resin 60 wt.parts
(Polyester formed from terephthalic acid, fumaric acid, trimellitic anhydride, bisphenol propoxy-adduct and bisphenol ethoxy-adduct; Tg=58.7° C., Mw=39,800, Mw/Mn=3.4, $G'_{100}=2.5\times10^4$ Pa)

EXAMPLE 11

Magnetic toner (11) was prepared in the same manner as in Example 4 except for replacing the high-modulus binder resin with the high-modulus polyester binder resin used in Example 10. The evaluation results are shown in Table 1.

EXAMPLE 12

Magnetic toner (12) was prepared in the same manner as in Example 10 except for replacing the low-modulus binder resin with the low-modulus vinyl binder resin used in Example 1. The evaluation results are shown in Table 1.

EXAMPLE 13

Magnetic toner (13) was prepared in the same manner as in Example 3 except for increasing the amount of the magnetic material to 100 wt. parts. As a result of evaluation in the same manner as in Example 1, in spite of the increased magnetic material content compared with Magnetic toner (3), Magnetic toner (13) showed almost equivalent results regarding the fixability and other evaluation items, thus showing good results as shown in Table 1.

Comparative Example 1

Comparative magnetic toner (1) was prepared in the same manner as in Example 3 except for replacing the wax with 7 wt. parts of ethylenepropylene copolymer (Tmp=146° C., Mw=17,700, Mw/Mn=3.1). Comparative magnetic toner (1) was evaluated in the same manner as in Example 1. The results are shown in Table 1.

Comparative Example 2

Comparative magnetic toner (2) was prepared in the same manner as in Example 3 except for replacing the high-modulus binder resin with styrenebutyl acrylate copolymer (Mw=278,300, Mw/Mn=2.3 and $G'_{100}=4.1\times10^3$ Pa, Tg=57.8° C.), omitting the high-melting point wax and using 7 wt. parts of the low-melting point wax.

Comparative magnetic toner (2) was evaluated by the same fixation test as in Example 1, whereby it showed a good fixability immediately after power supply but showed an offset phenomenon (presumably a high temperature-offset phenomenon) 20 min. after power supply to the heater.

Comparative Example 3

Comparative magnetic toner (3) was prepared in the same manner as in Comparative Example 1 except for increasing the amount of the magnetic material to 100 wt. parts. Compared with Comparative magnetic toner (1), Comparative magnetic toner (3) showed further worse fixability and also showed worse anti-blocking and anti-offset characteristics.

Comparative Example 4

Comparative magnetic toner (4) was prepared in the same manner as in Example 1 except for replacing the wax with 7 wt. parts of low-molecular weight polypropylene wax ("Viscol 550P", mfd. by Sanyo Kasei Kogyo K.K.). The magnetic toner was evaluated in the same manner as in Example 1. The results are also shown in Table 1.

The evaluation methods are explained below.

Low-temperature fixability (at 110° C.)

A toner image was fixed onto a plain paper at a heating roller surface temperature of 110° C., and the fixed toner image was rubbed 10 times each with a lens cleaning paper ("dasper", available from Ozu Paper Co. Ltd.) to measure an image density decrease due to the rubbing. The fixability was evaluated at 5 ranks according to the following standard.

Rank 5: density decrease of 0–5%

Rank 4: density decrease of 5–10%

Rank 3: density decrease of 11–20%

Rank 2: density decrease of 21–40%

Rank 1: density decrease of ≧41%

Anti-offset characteristic

A toner image was fixed onto plain paper at a heating roller surface temperature of 210° C., and another sheet of plain paper was passed through the fixing device to observe whether or not the transfer of the toner occurred from the heating roller surface to the plain paper. The results were evaluated at 5 ranks according to the following standard:

Rank 5: No toner transfer.

Rank 4: Very slight toner transfer.

Rank 3: Slight toner transfer.

Rank 2: Toner transfer clearly observed.

Rank 1: Paper was wound about the heating roller.

Anti-blocking test

Ca. 20 g of a magnetic toner sample was placed in a 100 cc-plastic cup and left standing at 50° C. for 10 days, whereby the toner state was observed with eyes. The results were evaluated at 5 ranks as follows.

Rank 5: No change.

Rank 4: Agglomerate formed but could be easily disintegrated.

Rank 3: Agglomerate not easily disintegrated.

Rank 2: No flowability.

Rank 1: Caking clearly occurred.

Image density (I.D.)

A maximum image density at solid black image part (with no edge effect) was measured by a densitometer ("Macbeth RD918", available from Macbeth Co.) with respect to the images obtained at the first stage and last stage during the $10^5$ sheets of continuous image formation.

Wax dispersibility in toner

Toner particles were observed through an optical microscope equipped with a polarizer at a low magnification (e.g., 50–500) to measure the number of bright spots representing wax particles isolated from toner particles with respect to 300 toner particles in the view field. The results were evaluated according to the following standards.

Rank 5: No bright spots

Rank 4: 1–10 bright spots.

Rank 3: 11–20 bright spots.

Rank 2: 21–50 bright spots.

Rank 1: ≧51 bright spots.

TABLE 1

Magnetic toner evaluation results

| Ex. or Comp. Ex. | Magnetic toner | $G'_{100}$ (Pa) | $G'_{60}/G'_{70}$ | $G''_{max}$ Value | $G''_{max}$ Temp. (°C.) | tan $\delta_{max}$ Value | tan $\delta_{max}$ Temp. (°C.) | Toner DSC curve (absorption) Main peak (°C.) | Toner DSC curve (absorption) Sub-peak or shoulder (°C.) |
|---|---|---|---|---|---|---|---|---|---|
| Ex. | | | | | | | | | |
| 1 | (1) | $2.6 \times 10^4$ | 43.3 | $1.1 \times 10^8$ | 52.7 | 3.2 | 66.7 | 75.4 | 106.8 |
| 2 | (2) | $2.7 \times 10^4$ | 49.6 | $1.6 \times 10^8$ | 53.1 | 3.2 | 67.2 | 74.8 | 107.0 |
| 3 | (3) | $3.1 \times 10^4$ | 52.1 | $2.0 \times 10^8$ | 53.9 | 3.5 | 68.8 | 75.1 | 108.0 |
| 4 | (4) | $3.2 \times 10^4$ | 53.3 | $1.9 \times 10^8$ | 54.3 | 3.6 | 69.6 | 75.6 | 108.4 |
| 5 | (5) | $2.8 \times 10^4$ | 68.2 | $2.1 \times 10^8$ | 53.7 | 3.5 | 68.5 | 75.4 | 108.8 |
| 6 | (6) | $2.2 \times 10^4$ | 73.8 | $2.1 \times 10^8$ | 54.4 | 3.7 | 69.2 | 75.9 | 108.9 |
| 7 | (7) | $3.9 \times 10^4$ | 78.4 | $2.8 \times 10^8$ | 57.8 | 2.1 | 69.5 | 69.3 | 101.7 |
| 8 | (8) | $3.5 \times 10^4$ | 84.7 | $2.6 \times 10^8$ | 58.0 | 2.3 | 69.6 | 69.3 | 102.6 |
| 9 | (9) | $3.7 \times 10^4$ | 88.0 | $2.7 \times 10^8$ | 58.2 | 2.3 | 69.4 | 69.8 | 103.3 |
| 10 | (10) | $3.3 \times 10^4$ | 94.4 | $2.6 \times 10^8$ | 57.0 | 2.7 | 68.3 | 69.7 | 103.2 |
| 11 | (11) | $3.2 \times 10^4$ | 72.1 | $2.3 \times 10^8$ | 54.0 | 3.0 | 68.1 | 75.5 | 108.2 |
| 12 | (12) | $3.0 \times 10^4$ | 81.3 | $2.1 \times 10^8$ | 55.2 | 2.8 | 68.8 | 69.6 | 103.6 |
| 13 | (13) | $3.5 \times 10^4$ | 50.7 | $2.1 \times 10^8$ | 54.2 | 3.3 | 69.2 | 75.0 | 108.1 |
| Comp. Ex. | Comp. | | | | | | | | |
| 1 | (1) | $6.3 \times 10^4$ | 18.8 | $4.3 \times 10^8$ | 55.5 | 2.9 | 76.4 | 145.7 | — |
| 2 | (2) | $2.7 \times 10^3$ | 129 | $7.2 \times 10^7$ | 47.4 | 2.6 | 61.7 | 74.7 | — |
| 3 | (3) | $7.5 \times 10^4$ | 15.7 | $5.7 \times 10^8$ | 56.2 | 2.5 | 77.0 | 76.3 | — |
| 4 | (4) | $6.7 \times 10^4$ | 19.1 | $4.1 \times 10^8$ | 54.9 | 2.7 | 76.1 | 139.7 | — |

| Ex. or Comp. Ex. | Magnatic toner | Fixability After power supply Rank | Fixability After 20 min. Rank | Anti-offset (210° C.) Rank | Anti-block (50° C., 10 days) Rank | Image density Initial | Image density Last | Wax. dispersion Rank |
|---|---|---|---|---|---|---|---|---|
| Ex. | | | | | | | | |
| 1 | (1) | 3 | 4 | 3 | 3 | 1.33 | 1.35 | 3 |
| 2 | (2) | 4 | 4 | 4 | 3 | 1.35 | 1.36 | 4 |

TABLE 1-continued

| Magnetic toner evaluation results | | | | | | | | |
|---|---|---|---|---|---|---|---|---|
| 3 | (3) | 4 | 5 | 5 | 4 | 1.39 | 1.4 | 4 |
| 4 | (4) | 4 | 5 | 5 | 5 | 1.4 | 1.4 | 5 |
| 5 | (5) | 5 | 5 | 5 | 4 | 1.4 | 1.4 | 5 |
| 6 | (6) | 5 | 5 | 5 | 5 | 1.42 | 1.41 | 5 |
| 7 | (7) | 5 | 5 | 4 | 4 | 1.37 | 1.4 | 4 |
| 8 | (8) | 5 | 5 | 5 | 5 | 1.4 | 1.42 | 5 |
| 9 | (9) | 5 | 5 | 5 | 5 | 1.43 | 1.42 | 5 |
| 10 | (10) | 5 | 5 | 5 | 5 | 1.41 | 1.42 | 5 |
| 11 | (11) | 5 | 5 | 4 | 5 | 1.36 | 1.38 | 4 |
| 12 | (12) | 4 | 5 | 5 | 5 | 1.37 | 1.38 | 4 |
| 13 | (13) | 4 | 5 | 5 | 4 | 1.36 | 1.38 | 4 |
| Comp. Ex. | Comp. | | | | | | | |
| 1 | (1) | 2 | 2 | 3 | 4 | 1.18 | 1.23 | 2 |
| 2 | (2) | 5 | 1 | 1 | 1 | 1.3 | 1.22 | 1 |
| 3 | (3) | 1 | 1 | 2 | 3 | 1.05 | 1.0 | 2 |
| 4 | (4) | 2 | 2 | 3 | 3 | 1.16 | 1.20 | 2 |

EXAMPLE 14

A magnetic toner was prepared from the following materials including Low-melting point wax (1) shown in Table 2 and High-melting point wax (1) shown in Table 3.

Binder resin 100 wt.parts
(Styrene-butyl acrylate-divinylbenzene copolymer prepared by solution polymerization; Mw=387,500, main-peak at a molecular weight of 5,400 and sub-peak at a molecular weight of 127,500; Tg=62.4° C.)

Magnetic material 90 wt.parts
(Dav.=0.2 μm)

Mono-azo metal complex 2 wt.parts
(negative charge control agent)

Low-melting point wax (1) 3 wt.parts

High-melting point wax (1) 3 wt.parts

The above materials were pre-blended by a Henschel mixer and melt-kneaded through a twin-screw kneading extrude at 130° C. After cooling, the kneaded product was coarsely crushed by a cutter mill and pulverized by a fine pulverizer using a jet air stream, followed by classification to obtain a negatively chargeable insulating magnetic toner having a weight-average particle size (Dw)=6.4 μm. The magnetic toner in 100 wt. parts was blended with 1.0 wt. art of negative chargeable hydrophobic dry-process silica ($S_{BET}$=300 $m^2/g$) as external additive by means of a Henschel mixer to obtain Magnetic toner (14).

The dispersibility of the wax in the toner was evaluated by observing the toner through an optical microscope equipped with a polarizer at a low magnification of ca. 60, whereby only several bright spots indicating the presence of isolated wax particles were observed with respect to 300 toner particles in the view field, thus sowing a good dispersion state.

The magnetic toner was subjected to $1\times10^5$ sheets of continuous image formation by using a digital copier ("GP-55", available from Canon K.K.). The resultant images showed an image density of 1.35 at the initial stage (1st of 10th sheets) and 1.37 at the end of the $10^5$ sheets of the continuous image formation, thus showing substantially no change. Good image qualities were obtained without causing image quality charges, such as scattering and thickening of line images. After completion of the $10^5$ sheets of continuous image formation, the photosensitive drum surface was observed, whereby the drum surface was found to be accompanied with no attachment of isolated wax or no noticeable damages. The resultant images also showed no image defects attributable to damages on the photosensitive drum.

Then, the fixing device of the digital copier was removed from the copier, and an externally driven fixing device remodeled so as to rotate at a fixing roller speed of 100 mm/min and equipped with a temperature controller so as to vary the fixing roller temperature within the range of 100°–200° C. As a result of a fixing test performed in this manner, the toner images fixed at 120° C. showed a density decrease by rubbing of ca. 8% and caused no high-temperature offset at 200° C. When ca. 10 g of Magnetic toner (14) was left standing for 7 days in a thermostat vessel controlled at 50° C. to effect an anti-blocking test, the resultant toner showed slight agglomeration which however could be easily disintegrated to recover good flowability.

The toner showed a glass transition temperature (Tg) of 62° C. which was substantially not lower than that of the binder resin and a DSC curve showing heat-absorption peaks corresponding to those of the low-melting pint wax and the high-melting point wax measured when these waxes alone were subjected to DSC measurement. The evaluation results are shown in Table 4 (composed of Table 4-1 and Table 4-2).

EXAMPLE 15

Magnetic toner (15) was prepared in the same manner as in Example 14 except that a wax mixture prepared by melt-mixing Low-melting point wax (1) and High-melting point wax (1) was used. The results of evaluation of Magnetic toner (15) in the same manner as in Example 14 are shown in Table 4.

EXAMPLE 16

Magnetic toner (16) was prepared in the same manner as in Example 14 except for adding Low-melting point wax (1) and High-melting point wax (1) respectively into a solution after solution polymerization containing the binder resin used in Example 14 and distilling off the solvent from the mixture to obtain a composition containing the waxes and the binder resin, which was then used for the toner preparation. The results of evaluation of Magnetic toner (16) in the same manner as in Example 14 are shown in Table 4.

EXAMPLE 17

Magnetic toner (17) was prepared in the same manner as in Example 16 except for using the preliminarily melt-mixed wax used in Example 15. The results of evaluation of the magnetic toner are shown in Table 4.

EXAMPLES 18–20

Magnetic toners (18)–(20) were prepared in the same manner as in Example 15 except for using low-melting point waxes shown in Table 2 and high-melting point waxes shown in Table 3 were used. The evaluation results are also shown in Table 4.

EXAMPLE 21

Terephthalic acid 15 mol. %

Fumaric acid 18 mol. %

Trimellitic anhydride 15 mol. %

Bisphenol A propoxy-adduct 28 mol. %

Bisphenol A ethoxy-adduct 20 mol. %

The above materials were subjected to polycondensation to prepare a nonlinear polyester resin (Mw=496,500, Mw/Mn=93.1, Tg=61° C.).

Separately, the following monomers were subjected to polycondensation to prepare a linear polyester resin (Mw=3000, Mw/Mn=2.3).

Terephthalic acid 31 mol. %

Fumaric acid 18 mol. %

Bisphenol A propoxy-adduct 28 mol. %

Bisphenol A ethoxy-adduct 20 mol. %

70 wt. parts of the linear polyester resin and 30 wt. parts of the non-linear polyester resin were used as the binder resin, together with a wax prepared by using a low-melting point wax shown in Table 2 and a high-melting point wax shown in Table 3 in the same manner as in Example 15, thereby to prepare Magnetic toner (21) otherwise in the same manner as in Example 14. The evaluation results are shown in Table 4.

EXAMPLE 22

Magnetic toner (22) was prepared in the same manner as in Example 21 except for heat-melting the binder resin and adding the waxes thereto for mixing to prepare a binder resin-wax mixture. The evaluation results are shown in Table 4.

EXAMPLES 23–25

Magnetic toners (23)–(25) were prepared in the same manner as in Example 21 except for producing waxes in the manner of Example 15 by mixing low-melting point waxes shown in Table 2 and high-melting point waxes shown in Table 3. The evaluation results are shown in Table 4.

Comparative Example 5

Comparative magnetic toner (5) was prepared in the same manner as in Example 14 except for using Low-melting point wax (1) alone. The magnetic toner was evaluated in the same manner as in Example 14. The results are shown in Table 5 (composed of Table 5-1 and 5-2).

Comparative Example 6

Comparative magnetic toner (6) was prepared in the same manner as in Example 14 except for using High-melting point wax (2) alone. The magnetic toner was evaluated in the same manner as in Example 14. The results are shown in Table 5.

Comparative Example 7

Comparative magnetic toner (7) was prepared in the same manner as in Example 14 except for using Low-melting point wax (6) and High-melting point wax (9) (ethylene-propylene copolymer). The magnetic toner was evaluated in the same manner as in Example 14. The results are shown in Table 5.

The toner provided a low image density of 1.1 and showed the presence of a large number of isolated wax particles among toner particles. At a point of time after $2\times10^4$ sheets of continuous image formation, the attachment of isolated wax was found on the photosensitive drum and partly damaged the photosensitive drum surface, resulting in corresponding scars and fog in the resultant images.

As a result of the fixing test, the images fixed at 120° C. caused a density decrease of ca. 35%. At an elevated fixing temperature of 200° C., the fixing was effected but a partial offset was observed.

As a result of DSC measurement, Comparative magnetic toner (7) showed a lowered Tg of 59° C., and substantially no heat-absorption peak was observed on the DSC curve at the melting point of the high-melting point wax component. The results are shown in Table 5.

Comparative Example 8

Comparative magnetic toner (8) was prepared in the same manner as in Comparative Example 7 except for using Low-melting point wax (9) in Table 2 and High-melting point wax (9) in Table 3. As a result of evaluation in the same manner as in Example 14, the magnetic toner showed a good low-temperature fixability but showed inferior anti-offset and anti-blocking characteristics. The results are shown in Table 5.

Comparative Example 9

Comparative magnetic toner (9) was prepared in the same manner as in Comparative Example 7 except for using Low-melting point wax (10) in Table 2 and High-melting point wax (10) (ethylene-propylene copolymer) in Table 3. The magnetic toner was evaluated in the same manner as in Example 14. The results are shown in Table 5.

Low-temperature fixability

The heating roller surface temperature was changed to 120° C., and otherwise similar evaluation as in Example 1 was performed.

Anti-offset characteristic

The heating roller surface temperature was changed to 200° C., and otherwise similar evaluation as in Example 1 was performed.

Anti-blocking characteristic

Image density

Wax dispersibility

Evaluation was performed similarly as in Example 1.

TABLE 2

| Low-melting point waxes | | | | | |
|---|---|---|---|---|---|
| Identi- | Tmp | | | Substituent | |
| fixation | (°C.) | Mw | Mw/Mn | Yes or No | Type |
| (1) | 69 | 460 | 1.7 | no | — |
| (2) | 81 | 670 | 1.9 | no | — |
| (3) | 75 | 450 | 2.0 | no | — |
| (4) | 63 | 430 | 1.5 | no | — |

TABLE 2-continued

| Low-melting point waxes | | | | | |
|---|---|---|---|---|---|
| Identi-fixation | Tmp (°C.) | Mw | Mw/Mn | Substituent Yes or No | Substituent Type |
| (5) | 78 | 540 | 2.1 | yes | hydroxyl |
| (6) | 86 | 600 | 2.2 | yes | hydroxyl |
| (7) | 71 | 510 | 1.9 | no | — |
| (8) | 66 | 440 | 2.2 | yes | carboxyl |
| (9) | 53 | 340 | 2.1 | no | — |
| (10) | 57 | 390 | 2.0 | no | — |

TABLE 4-1

| Evaluation of magnetic toners | | | | | | |
|---|---|---|---|---|---|---|
| | Low-melting point wax | | High-melting point wax | | | |
| Ex. or Comp. Ex. | Type | Amount (wt. parts) | Type | Amount (wt. parts) | $\frac{T_{ML}+T_{MH}}{2}$ | $T_{ML}-T_{MH}$ |
| Ex. 14 | (1) | 3 | (1) | 3 | 87 | 36 |
| 15 | (1) | 3 | (1) | 3 | 87 | 36 |
| 16 | (1) | 3 | (1) | 3 | 87 | 36 |
| 17 | (1) | 3 | (1) | 3 | 87 | 36 |
| 18 | (2) | 5 | (2) | 2 | 95 | 27 |
| 19 | (3) | 4 | (3) | 3 | 96.5 | 43 |
| 20 | (4) | 2 | (4) | 5 | 78 | 30 |
| 21 | (5) | 3 | (5) | 2 | 99 | 42 |
| 22 | (5) | 3 | (5) | 2 | 99 | 42 |
| 24 | (6) | 3 | (6) | 5 | 99.5 | 27 |
| 25 | (7) | 2 | (7) | 5 | 89.5 | 37 |
| 26 | (8) | 4 | (8) | 3 | 94.5 | 57 |

TABLE 4-2

| Evaluation of magnetic toners | | | | | | | | | | | | | | |
|---|---|---|---|---|---|---|---|---|---|---|---|---|---|---|
| | | | $G''_{max}$ | | $\tan\delta_{max}$ | | Toner DSC curve (absorption) | | | | | | | |
| Ex. or Comp. Ex. | $G'_{100}$ (Pa) | $G'_{60}/G'_{70}$ | Value | Temp. (°C.) | Value | Temp. (°C.) | Main peak (°C.) | Sub-peak or shoulder (°C.) | Image density Initial | Image density Last | Fixability (120° C.) Rank | Anti-offset (200° C.) Rank | Anti-block (50° C., 7 days) Rank | Wax dispersion Rank |
| Ex. | | | | | | | | | | | | | | |
| 14 | $1.9\times10^4$ | 40.7 | $2.3\times10^8$ | 55.7 | 3.9 | 72.2 | 69.3 | 104.7 | 1.35 | 1.37 | 4 | 5 | 4 | 4 |
| 15 | $2.0\times10^4$ | 42.6 | $2.4\times10^8$ | 55.8 | 3.8 | 71.3 | 69.0 | 105.2 | 1.42 | 1.43 | 5 | 5 | 5 | 5 |
| 16 | $2.2\times10^4$ | 47.1 | $2.5\times10^8$ | 56.0 | 4.0 | 73.5 | 69.1 | 105.7 | 1.36 | 1.4 | 4 | 5 | 5 | 5 |
| 17 | $2.3\times10^4$ | 50.2 | $2.1\times10^8$ | 55.6 | 4.0 | 73.9 | 69.7 | 106.1 | 1.43 | 1.44 | 5 | 5 | 5 | 5 |
| 18 | $2.9\times10^4$ | 43.1 | $2.8\times10^8$ | 56.6 | 3.7 | 74.6 | 81.6 | 108.8 | 1.4 | 1.4 | 4 | 5 | 5 | 5 |
| 19 | $2.7\times10^4$ | 46.7 | $2.7\times10^8$ | 56.5 | 3.2 | 74.3 | 75.7 | 119.1 | 1.4 | 1.43 | 5 | 5 | 5 | 5 |
| 20 | $1.7\times10^4$ | 53.3 | $2.0\times10^8$ | 55.2 | 3.1 | 72.6 | 63.8 | 93.8 | 1.38 | 1.4 | 5 | 4 | 4 | 5 |
| 21 | $1.4\times10^4$ | 63.6 | $2.2\times10^8$ | 56.6 | 2.7 | 69.8 | 77.9 | 119.6 | 1.36 | 1.4 | 5 | 5 | 4 | 4 |
| 22 | $1.7\times10^4$ | 63.7 | $2.0\times10^8$ | 56.9 | 2.9 | 69.7 | 77.7 | 120.3 | 1.4 | 1.42 | 5 | 5 | 5 | 5 |
| 24 | $1.8\times10^4$ | 61.2 | $2.6\times10^8$ | 57.3 | 2.6 | 70.1 | 86.5 | 113.4 | 1.39 | 1.41 | 4 | 4 | 5 | 5 |
| 25 | $1.5\times10^4$ | 65.3 | $1.8\times10^8$ | 56.8 | 2.3 | 69.4 | 71.7 | 108.1 | 1.42 | 1.43 | 5 | 5 | 4 | 5 |
| 26 | $1.5\times10^4$ | 62.0 | $2.4\times10^8$ | 56.9 | 2.7 | 68.8 | 66.6 | 123.7 | 1.36 | 1.38 | 4 | 5 | 5 | 4 |

TABLE 3

| High-melting point waxes | | | | | |
|---|---|---|---|---|---|
| Identi-fixation | Tmp (°C.) | Mw | Mw/Mn | Substituent Yes or No | Substituent Type |
| (1) | 105 | 820 | 2.0 | yes | hydroxyl |
| (2) | 109 | 1060 | 1.9 | no | — |
| (3) | 118 | 2060 | 2.2 | no | — |
| (4) | 93 | 740 | 1.4 | no | — |
| (5) | 120 | 4180 | 1.5 | no | — |
| (6) | 113 | 1350 | 1.7 | yes | hydroxyl |
| (7) | 108 | 970 | 2.4 | yes | carboxyl |
| (8) | 123 | 9300 | 1.6 | no | — |
| (9) | 147 | 17100 | 3.4 | no | — |
| (10) | 138 | 21800 | 4.7 | no | — |

TABLE 5-1

| Evaluation of comparative magnetic toners | | | | | | |
|---|---|---|---|---|---|---|
| | Low-melting point wax | | High-melting point wax | | | |
| Ex. or Comp. Ex. | Type | Amount (wt. parts) | Type | Amount (wt. parts) | $\frac{T_{ML}+T_{MH}}{2}$ | $T_{ML}-T_{MH}$ |
| Comp. Ex. 5 | (1) | 6 | — | — | — | — |
| 6 | — | — | (1) | 6 | — | — |
| 7 | (6) | 3 | (9) | 3 | 124 | 76 |
| 8 | (9) | 3 | (9) | 3 | 100 | 94 |
| 9 | (10) | 3 | (10) | 3 | 97.5 | 81 |

TABLE 5-2

Evaluation of comparative magnetic toner

| Ex. or Comp. Ex. | $G'_{100}$ (Pa) | $G'_{60}/G'_{70}$ | $G''_{max}$ Value | $G''_{max}$ Temp. (°C.) | $\tan\delta_{max}$ Value | $\tan\delta_{max}$ Temp. (°C.) | Toner DSC curve (absorption) Main peak (°C.) | Toner DSC curve (absorption) Sub-peak or shoulder (°C.) | Image density Initial | Image density Last | Fixability (120° C.) Rank | Anti-offset (200° C.) Rank | Anti-block (50° C., 7 days) Rank | Wax dispersion Rank |
|---|---|---|---|---|---|---|---|---|---|---|---|---|---|---|
| Comp. Ex. | | | | | | | | | | | | | | |
| 5 | $8.2 \times 10^3$ | 15.2 | $7.3 \times 10^7$ | 49.3 | 1.3 | 61.9 | 68.8 | — | 1.15 | 1.18 | 5 | 1 | 2 | 1 |
| 6 | $8.2 \times 10^4$ | 14.9 | $3.4 \times 10^8$ | 58.9 | 1.4 | 75.4 | 108.9 | — | 1.22 | 1.25 | 1 | 5 | 5 | 3 |
| 7 | $7.1 \times 10^4$ | 13.7 | $3.2 \times 10^8$ | 59.2 | 1.4 | 73.9 | 86.2 | 147.4 | 1.1 | 1.05 | 2 | 3 | 3 | 1 |
| 8 | $6.9 \times 10^3$ | 17.3 | $7.0 \times 10^7$ | 46.5 | 1.2 | 60.8 | 52.7 | 146.2 | 1.0 | 1.0 | 5 | 1 | 1 | 1 |
| 9 | $7.6 \times 10^3$ | 10.1 | $7.1 \times 10^7$ | 47.1 | 1.2 | 61.2 | 53.3 | 138.5 | 1.1 | 1.1 | 2 | 2 | 2 | 1 |

What is claimed is:

1. A toner for developing an electrostatic image, comprising: a binder resin, a colorant and a wax; wherein the toner has (a) a storage modulus at 100° C. ($G'_{100}$) of $1\times10^4$ Pa to $5\times10^4$ Pa, and (b) a storage modulus at 60° C. ($G'_{60}$) and a storage modulus at 70° C. ($G'_{70}$) providing a ratio ($G'_{60}/G'_{70}$) of at least 30.

2. The toner according to claim 1, wherein the ratio ($G'_{60}/G'_{70}$) is 30–120.

3. The toner according to claim 1 or 2, wherein the binder resin includes a low-modulus binder resin component and a high-modulus binder resin component.

4. The toner according to claim 3, wherein the low-modulus binder resin component has $G'_{100}$ satisfying $1\times10^2$ Pa$\leqq G'_{100}<1\times10^4$ Pa.

5. The toner according to claim 3, wherein the high-modulus binder resin component has $G'_{100}=1\times10^4-1\times10^6$ Pa.

6. The toner according to claim 3, wherein the low-modulus binder resin component has $G'_{100}$ satisfying $1\times10^2$ Pa$\leqq G'_{100}<1\times10^4$ Pa, and the high-modulus binder resin component has $G'_{100}=1\times10^4-1\times10^6$ Pa.

7. The toner according to claim 1, wherein the toner provides a DSC curve as measured by using a differential scanning calorimeter showing a heat-absorption main peak in a temperature region of 60°–135° C.

8. The toner according to claim 7, wherein the toner provides a DSC curve as measured by using a differential scanning calorimeter showing a heat-absorption main peak in a temperature region of 60°–100° C.

9. The toner according to claim 7, wherein the toner provides a DSC curve as measured by using a differential scanning calorimeter showing a heat-absorption main peak and a heat-absorption sub-peak in a temperature region of 60°–135° C.

10. The toner according to claim 9, wherein the toner provides a DSC curve as measured by using a differential scanning calorimeter showing a heat-absorption main peak in a temperature region of 60°–100° C.

11. The toner according to claim 7, wherein the toner provides a DSC curve as measured by using a differential scanning calorimeter showing a heat-absorption main peak and a heat-absorption shoulder in a temperature region of 60°–135° C.

12. The toner according to claim 11, wherein the toner provides a DSC curve as measured by using a differential scanning calorimeter showing a heat-absorption main peak in a temperature region of 60°–100° C.

13. The toner according to claim 1, wherein the wax provides a DSC curve as measured by using a differential scanning calorimeter showing a heat-absorption main peak in a temperature region of 60°–135° C.

14. The toner according to claim 13, wherein the wax provides a DSC curve as measured by using a differential scanning calorimeter showing a heat-absorption main peak in a temperature region of 60°–100° C.

15. The toner according to claim 13, wherein the wax provides a DSC curve as measured by using a differential scanning calorimeter showing a heat-absorption main peak and a heat-absorption sub-peak in a temperature region of 60°–135° C.

16. The toner according to claim 15, wherein the wax provides a DSC curve as measured by using a differential scanning calorimeter showing a heat-absorption main peak in a temperature region of 60°–100° C.

17. The toner according to claim 13, wherein the wax provides a DSC curve as measured by using a differential scanning calorimeter showing a heat-absorption main peak and a heat-absorption shoulder in a temperature region of 60°–135° C.

18. The toner according to claim 17, wherein the wax provides a DSC curve as measured by using a differential scanning calorimeter showing a heat-absorption main peak in a temperature region of 60°–100° C.

19. The toner according to claim 1, wherein the wax comprises a low-melting point wax having a melting point of 60°–94° C., and a high-melting point wax having a melting point of 95°–135° C.

20. The toner according to claim 1, wherein the wax comprises a low-melting point wax having a melting point of 70°–90° C., and a high-melting point wax having a melting point of 95°–130° C.

21. The toner according to claim 1, wherein the wax comprises a low-melting point wax having a melting point of 70°–90° C., and a high-melting point wax having a melting point of 100°–130° C.

22. The toner according to claim 1, wherein the wax comprises a low-melting point wax having a melting point $T_{ML}$ (°C.) and a high-melting point wax having a melting point $T_{MH}$ (°C.) satisfying:

$$80\leqq(T_{ML}+T_{MH})/2\leqq110,$$

and $T_{MH}-T_{ML} \geqq 20$.

23. The toner according to claim 22, wherein $T_{ML}$ and $T_{MH}$ provide a difference therebetween of 20° to 75° C.

24. The toner according to claim 1, wherein the toner has $G'_{100}=1\times10^4-4.5\times10^4$ Pa.

25. The toner according to claim 1, wherein the toner has $G'_{100}=1.5\times10^4-4\times10^4$ Pa.

26. The toner according to claim 1, wherein the toner has $(G'_{60}/G'_{70})=35-120$.

27. The toner according to claim 1, wherein the toner has $(G'_{60}/G'_{70})=40-110$.

28. The toner according to claim 1, wherein the toner has $G'_{60} \geqq 7\times10^6$ Pa.

29. The toner according to claim 1, wherein the toner has $G'_{60}=1\times10^7-5\times10^8$ Pa.

30. The toner according to claim 1, wherein the toner has $G'_{60}=2\times10^7-4\times10^8$ Pa.

31. The toner according to claim 1, wherein the toner has $G'_{70} \leqq 7\times10^6$ Pa.

32. The toner according to claim 1, wherein the toner has $G'_{70}=6\times10^5-6\times10^6$ Pa.

33. The toner according to claim 1, wherein the toner has $G'_{70}=8\times10^5-5\times10^6$ Pa.

34. The toner according to claim 1, wherein the toner has a maximum of loss modulus (G") of $8\times10^7-5\times10^8$ Pa in a temperature range of 48°–65° C.

35. The toner according to claim 1, wherein the toner has a maximum of loss modulus (G") of $9\times10^7-4\times10^8$ Pa in a temperature range of 49°–63° C.

36. The toner according to claim 1, wherein the toner has a maximum of loss modulus (G") of $1\times10^7-3\times10^8$ Pa in a temperature range of 50°–60° C.

37. The toner according to claim 1, wherein the toner has a loss modulus G" and a storage modulus G' providing a ratio (G"/G'=tan δ) of at least 0.5 at a temperature in a range of 60°–100° C.

38. The toner according to claim 37, wherein the ratio (G"/G'=tan δ) has a maximum of at least 1.5 in a temperature range of 63°–78° C.

39. The toner according to claim 38, wherein the ratio (G"/G'=tan δ) has a maximum in a temperature range of 64°–75° C.

40. The toner according to claim 38, wherein the ratio (G"/G'=tan δ) has a maximum in a temperature range of 65°–73° C.

41. The toner according to claim 1, wherein the colorant comprises a magnetic material.

42. The toner according to claim 41, wherein the magnetic material is contained in 10–200 wt. parts per 100 wt. parts of the binder resin.

43. The toner according to claim 41, wherein the magnetic material is contained in 20–150 wt. parts per 100 wt. parts of the binder resin.

44. The toner according to claim 1, wherein the colorant comprises a non-magnetic colorant.

45. The toner according to claim 44, wherein the non-magnetic colorant is contained in 0.1–60 wt. parts per 100 wt. parts of the binder resin.

46. The toner according to claim 44, wherein the non-magnetic colorant is contained in 0.5–50 wt. parts per 100 wt. parts of the binder resin.

47. The toner according to claim 1, wherein the toner has a weight-average particle size of 3–9 μm.

48. The toner according to claim 1, wherein the toner has a weight-average particle size of 3–8 μm.

* * * * *